US006698459B2

(12) United States Patent
Aronson

(10) Patent No.: US 6,698,459 B2
(45) Date of Patent: Mar. 2, 2004

(54) COIL SPRING ASSEMBLY MACHINE

(75) Inventor: Terry Aronson, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/116,244

(22) Filed: Apr. 4, 2002

(65) Prior Publication Data

US 2003/0075232 A1 Apr. 24, 2003

(51) Int. Cl.[7] ..... B21F 27/16
(52) U.S. Cl. ..... 140/92.8; 140/3 CA
(58) Field of Search ..... 140/3 CA, 92.8, 140/92.94

(56) References Cited

U.S. PATENT DOCUMENTS

| | | | |
|---|---|---|---|
| 2,026,276 | A | 12/1935 | Erickson |
| 2,414,372 | A | 1/1947 | Frankel |
| 3,339,593 | A | 9/1967 | Krakauer et al. |
| 3,516,451 | A | 6/1970 | Spuhl |
| 3,774,652 | A | 11/1973 | Sturm |
| 3,875,976 | A | 4/1975 | Heimlich et al. |
| 4,492,298 | A | 1/1985 | Zapletal et al. |
| 4,724,590 | A | 2/1988 | Langas et al. |
| 4,829,643 | A | 5/1989 | Ayres et al. |
| 4,907,327 | A | 3/1990 | Ayres et al. |
| 5,509,642 | A | 4/1996 | Wells |
| 5,803,440 | A | 9/1998 | Wells |
| 6,149,143 | A | 11/2000 | Richmond et al. |

*Primary Examiner*—Lowell A. Larson
(74) *Attorney, Agent, or Firm*—Wood, Herron & Evans, L.L.P.

(57) ABSTRACT

An apparatus for assembling coil springs together into a matrix of coil springs. The apparatus has workholders with respective grippers that receive and hold portions of end turns of respective coil springs, and a loader supporting the workholders for moving the workholders through a motion that transfers the respective coil springs from a conveyor to the apparatus. The coil assembling apparatus has, for each coil, a die set having a fixed die and a movable die. The movable die is connected to a drive via linkage. The drive is operable to move the movable die through a motion that maintains a planar die face of the movable die substantially parallel to a planar die face of the stationary die. The coil assembling apparatus is also operable to automatically assemble two rows of coil springs into a row of coaxial coil springs.

49 Claims, 18 Drawing Sheets

COIL SPRING ASSEMBLY MACHINE

FIELD OF THE INVENTION

This invention relates generally to the assembly of coil springs of the type used in bedding and upholstery and, more particularly, to an improved machine for fabricating coil spring assemblies.

BACKGROUND OF THE INVENTION

It is well known to fabricate a coil spring assembly from a plurality of coil springs organized in matrix-like fashion into columns and rows. Often the coil spring rows are interconnected in both the top and bottom planes of the assembly. The rows and columns of the matrix are held in spatial relation in the finished assembly by some type of fastener or tie, for example, a lacing wire, that interconnects adjacent springs throughout the matrix one with the other. The helical lacing wire extends from one edge to the opposite edge of the spring assembly between adjacent rows of that assembly. The lacing wire connects adjacent springs within adjacent rows simply by being wound around the juxtaposed lacing legs or end turns of the adjacent springs. After fabrication of the coil spring assembly, manufacture of a finished product is completed by placing a cushion or pad of material, e.g., woven or non-woven batting, foam rubber, or the like, over the top and/or bottom surface of the spring assembly matrix so formed, and then enclosing that structure with an upholstered fabric or cloth sheath or the like to provide a finished saleable product. One basic use of such coil spring assemblies is in the bedding industry where those assemblies find use as mattresses or box springs, but other uses are in the home finishing industry where the finished coil spring assembly may be used in a chair's seat or a chair's backrest or the like.

An automatic machine for assembling continuous coil spring rows is also known. Such a machine initially picks up a row of coil springs by inserting pickup blades within the spring's barrel and moving the spring through a 90° arc onto a support surface. The row of springs is then compressed against the support surface, and thereafter, the row of springs is pushed between upper and lower die boxes by upper and lower rotating transfer fingers. Assuming a row of coil springs had previously been loaded in the die boxes, upper and lower clamping dies are closed to secure lacing legs of respective top and bottom turns of the two rows of coils. A helical lacing wire is then wound around the clamped lacing legs of the two rows of coils to connect the two rows of coils together. After the two rows of coil spring rows are connected, upper and lower indexing hooks grab the connected coils and index them in a downstream direction so as to permit a next row of springs to be fed between the upper and lower die boxes and connected to the assembly. When a desired number of rows of springs have been connected, a feed-out mechanism is cycled to move the completed spring assembly away from the machine.

The known coil spring assembly machine has a feed conveyor for delivering coil springs to the pickup blades for each row of coils. The feed conveyor grips the coil at a location intermediate the coil ends and orients the coil horizontally so that the coil centerline is aligned with one of the pickup blades. The pickup blades are translated into the barrels of respective coils, and then, the pickup blades are pivoted 90° to a vertical position. The pivoting motion removes the coils from the feed conveyor and locates a row of coils on a support surface. While the above coil spring pickup mechanism works satisfactorily, it does have some disadvantages. First, as a pickup blade translates into a barrel of a coil, it passes across a path of the feed conveyor that moves in a direction perpendicular to the path of the pickup blade. Therefore, if, for any reason, the feed conveyor moves prior to the pickup blade initiating its pivoting motion, the feed conveyor would hit the pickup blade and potentially damage the pickup blade and supporting arm. Thus, there is a need for a device that receives a coil spring from a feed conveyor in a manner that does not cross the path of the feed conveyor.

The pickup blade has another disadvantage. Its length must accommodate the length of the coil as well as the length of the reciprocating stroke and the actuator that provides that stroke. Therefore, the pickup blade and supporting arm can be 24 inches or more in length. That substantial length not only increases the footprint of the machine and consumes valuable manufacturing space, but it also further separates a machine operator from a coil assembly portion of the machine. Therefore, if there is any problem or adjustment around the lacing machine in the coil assembly portion of the machine, the length of the pickup blade and supporting arm make it very difficult for the machine operator to reach in and service that area. Thus, there is a further need for a device that receives a coil spring from the feed conveyor and pivots the coil spring up to the support surface but is substantially smaller than known pickup blades.

Further, the known coil assembling machine has a pair of clamping dies for each coil location in the two rows of coil springs that are being laced together. Thus, there may be a dozen or more pairs of dies across a width of a platen that must be operated together. Each pair of dies is pivoted in a scissors style about a common pivot. The upstream or front dies of each pair of dies are opened or lowered, and the downstream or rear dies of each pair of dies are raised or closed as a coil is fed into the dies. Thereafter, the front dies are pivoted to a closed position to clamp the end turns of the coils in the two adjacent rows of coils between the two dies while the helical lacing wire is wrapped around lacing legs of respective coil springs. After the two rows of coils have been laced together, all of the dies are pivoted to an open position and the laced rows of coils are indexed forward without any interference between the rows of coils and the dies. The rear dies are then closed while the front dies remain open for reception of the next row of coils.

While the above die mechanism effectively secures the coil springs during the lacing process, it does have some disadvantages. The requirement of having the two dies in each pair of dies pivot up to a common plane places a significant demand on the die mechanisms. Thus, the die mechanisms must be constantly monitored and adjusted, if necessary, to maintain them in proper operating condition.

The above die mechanism has another disadvantage that relates to its pivoting motion. If any of the coil springs are not perfectly located, it may interfere with the rear die closing position. Thus, the rear die will strike the coil spring before it has finished its pivoting motion, and an upwardly angled force is applied against the end turn or loop of the coil spring. That force is reacted by the hood portion of the front die. After repeated applications of such an angled force, the hood of the front or rear dies often break. Thus, there is a need for a die mechanism that requires less maintenance and that repeatedly and reliably closes to its desired horizontal position, so that the creation of nonhorizontal forces is minimized.

The known coil assembly machine has a further disadvantage in not being able to automatically assemble coaxial coils. In many innerspring structures, it is desirable that some areas of the innerspring structure have a different stiffness or firmness than other areas. In one application, an increased firmness in a selected area is provided by utilizing a coil within a coil design in which a pair of coils, that is, an inner coil and an outer coil, are used to provide a coil unit having a greater stiffness. When one or more rows of such pairs of coils are laced together, they will provide an area of the innerspring structure that has an increased firmness. Thus, there is a need for a coil assembly machine that has the capability of handling and assembling rows of coils that have multiple coil springs in the row.

Consequently, there is a need for a coil spring assembly machine that not only is free of the disadvantages of known machines but is capable of handling and assembling coaxial coil springs.

SUMMARY OF THE INVENTION

The present invention provides a coil spring assembly machine that is capable of providing a spring structure of a matrix of coil springs that has areas of different firmness or stiffness. The coil spring assembly machine of the present invention is capable of forming one or more rows of coaxial coils along with rows of single coils. The coil spring assembly machine of the present invention is more reliable in operation and provides greater operator access in the event of a jam or other error condition. Thus, the coil spring assembly machine of the present invention is especially useful in manufacturing innerspring structures for furniture.

According to the principles of the present invention and in accordance with the described embodiments, the invention provides an apparatus for assembling coil springs together into a matrix of coil springs. The apparatus has workholders with respective grippers that receive and hold portions of end turns of respective coil springs, and a loader supporting the workholders for moving the workholders through a motion that transfers the respective coil springs from a conveyor to the apparatus. In one aspect of this embodiment, the portions of the end turns are resiliently secured in the grippers. By holding the end turns of the coils when moving the coils from a conveyor to the apparatus, the workholders and loader have an advantage of being substantially smaller than known devices that perform the same function. The smaller size permits better access to a lacing portion of the apparatus.

In another embodiment of the invention, the coil assembling apparatus has, for each coil, a die set having a fixed die and a movable die. The movable die is connected to a drive via linkage. The drive is operable to move the movable die through a motion that maintains a second planar die face of the movable die substantially parallel to a first planar die face of the stationary die. In one aspect of this embodiment, the linkage is a four-bar linkage and a toggle. This embodiment has an advantage of not requiring any adjustment by the user. In addition, the parallel motion of the die faces provides a more reliable and proper alignment of the coil springs within the dies and minimizes the likelihood of die breakage. The use of a toggle provides a further advantage of reacting the load of the closed dies instead of the toggle drive mechanism.

In a further embodiment of the invention, the coil assembling apparatus is operable to automatically assemble two rows of coil springs into a row of coaxial coil springs. The apparatus has a die set for each coil spring in the row of coil springs and a plurality of lifters, wherein each lifter is mounted adjacent a different one of the die sets. The lifters are movable to lift an upstream leg of an end turn of a first coil spring in the first row of coil springs that is located in a respective die set. Lifting the upstream leg of the first coil in the first row of coils permits a downstream leg of an end turn of a first coil spring in a second row of coil springs to be moved below the upstream leg of the first coil spring of the first row of coils. This interweaving of the legs of the end turns of the coil springs permits the formation of a row of coaxial coil springs from the coil springs in the first and second rows. In one aspect of this invention, the lifter is a lifter wheel with a lift cam. By lacing together rows of coaxial coils with rows of single coils, the firmness of a resulting coil spring structure can be readily varied.

In still further embodiments of the invention, methods associated with the above-described embodiments are also provided.

These and other objects and advantages of the present invention will become more readily apparent during the following detailed description taken in conjunction with the drawings herein.

DETAILED DESCRIPTION OF THE INVENTION

Figure 1:
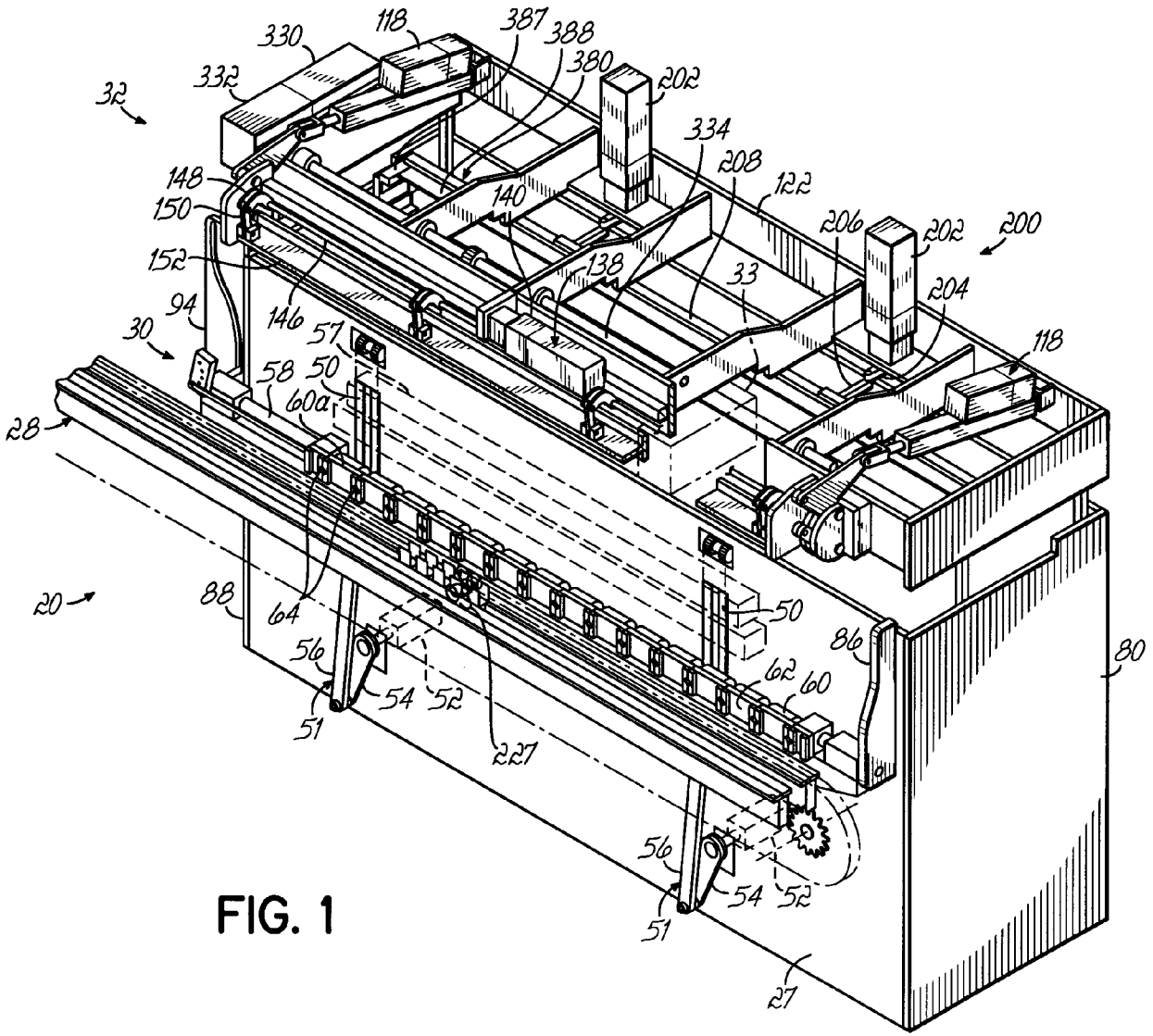
FIG. 1 is a perspective view of a spring coil assembly machine in accordance with the principles of the present invention.
Figure 2:
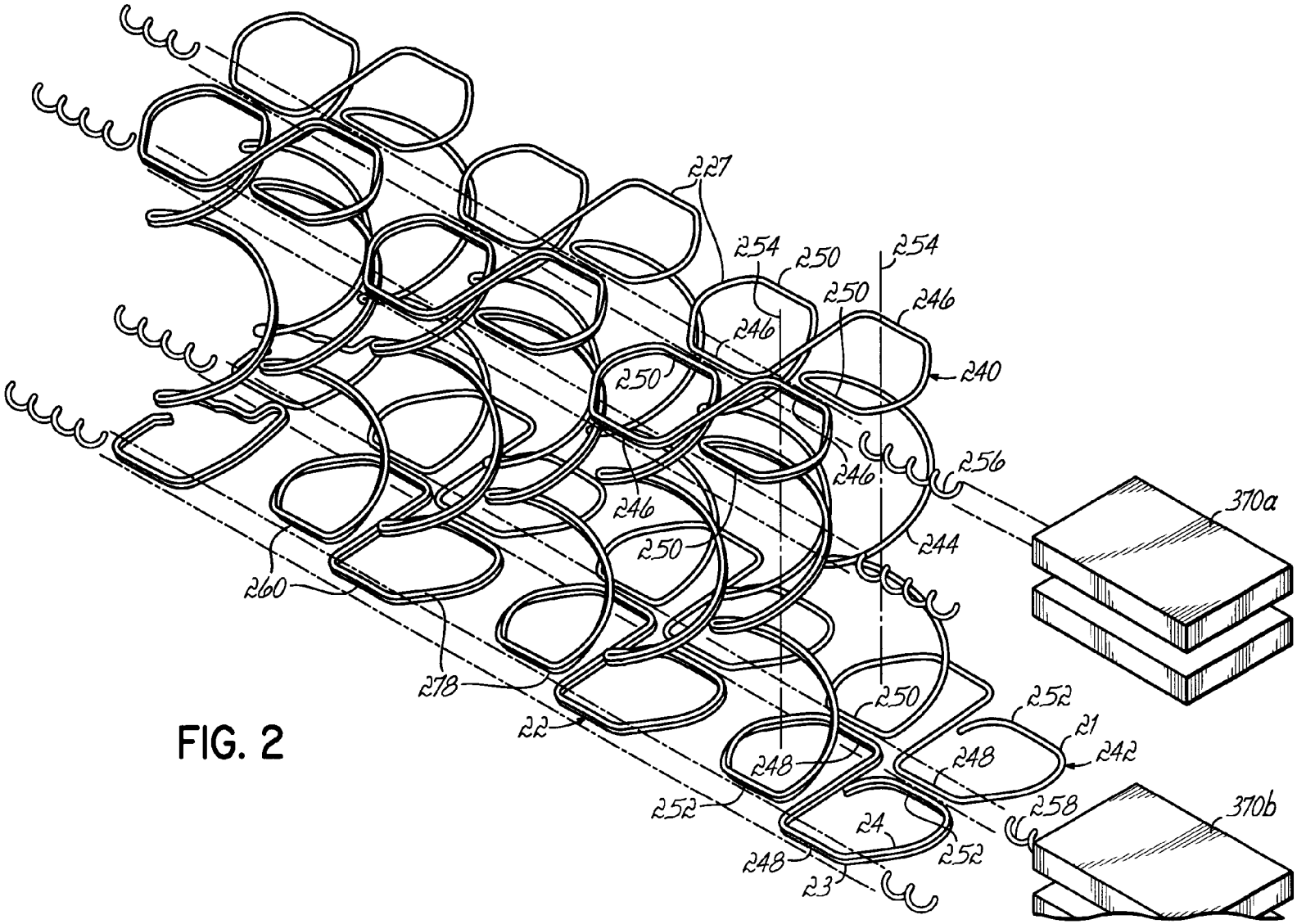
FIG. 2 is a perspective view of a row of continuous wire single coils and a row of continuous wire coaxial coils that form a spring structure that can be manufactured with the spring coil assembly machine of FIG. 1.
Figure 8:
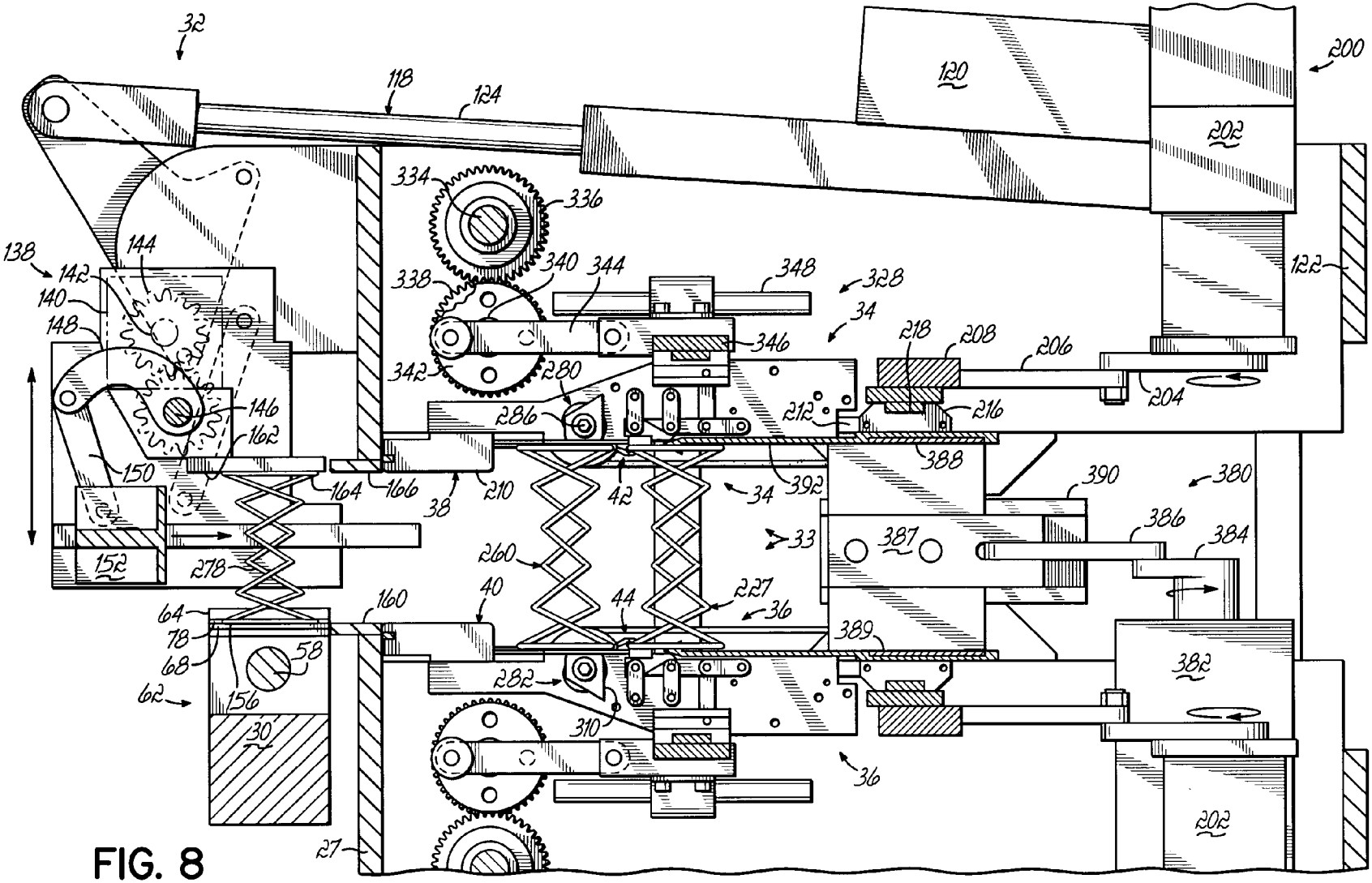
FIG. 8 is a partial cross-sectional view illustrating one set of die boxes in the spring coil assembly machine of FIG. 1.

Referring to FIG. 1, a spring coil assembly machine 20 is capable of stacking and lacing rows of continuous wire coils into a matrix of rows and columns of coils as shown in FIG. 2. The assembly machine 20 is capable of stacking and lacing rows of single continuous wire coils as well as rows of continuous wire coaxial coils. Such coaxial coils are described in detail in U.S. Pat. No. 6,149,143 entitled "Spring Structure for a Mattress Inner Spring Having Coaxial Coil Units" and the entirety of which is hereby incorporated by reference herein. The pair of coaxial coils is comprised of a first continuous wire coil 23 and a second continuous wire coil 24. Referring back to FIG. 1, a row of continuous wire coils indicated by a single coil 227 is indexed past a front side 27 of the assembly machine 20 on a feed conveyor 28 that orients the coil centerlines horizontally. When a row of coils is presented to the assembly machine 20, a preloader 30 lifts the row of coils from the feed conveyor 28, pivots the row of coils to a vertical orientation and positions the row of coils, so that it can be loaded into the assembly machine 20. A transfer mechanism 32 drops into position, supports a compression of the row of coils and pushes it from the preloader 30 to an input of a plurality of pairs of die boxes 33. There is a pair of die boxes 33 for each coil in the row of coils. Referring to FIG. 8, each pair of die boxes 33 is comprised of upper and lower die boxes 34, 36, respectively. The first row of coil springs is represented by the coil 227, and a second row of coil springs is represented by the coil 260. The rows of coil springs are pushed by upper and lower slider mechanisms 38, 40 into respective upper and lower die sets 42, 44. Each of the die sets has a stationary front die 230 and a movable rear die 238. After two or more rows of coils are positioned within the die sets 42, 44, the die sets are closed to precisely locate lacing legs of coils in the adjacent rows of coils; and a lacing machine (not shown) feeds a helical lacing wire around the lacing legs in a known manner, thereby tying or connecting the adjacent rows of coils together. The above automatic process is continuously repeated until a desired matrix of rows of coils is produced.

Preloader

Figure 19:
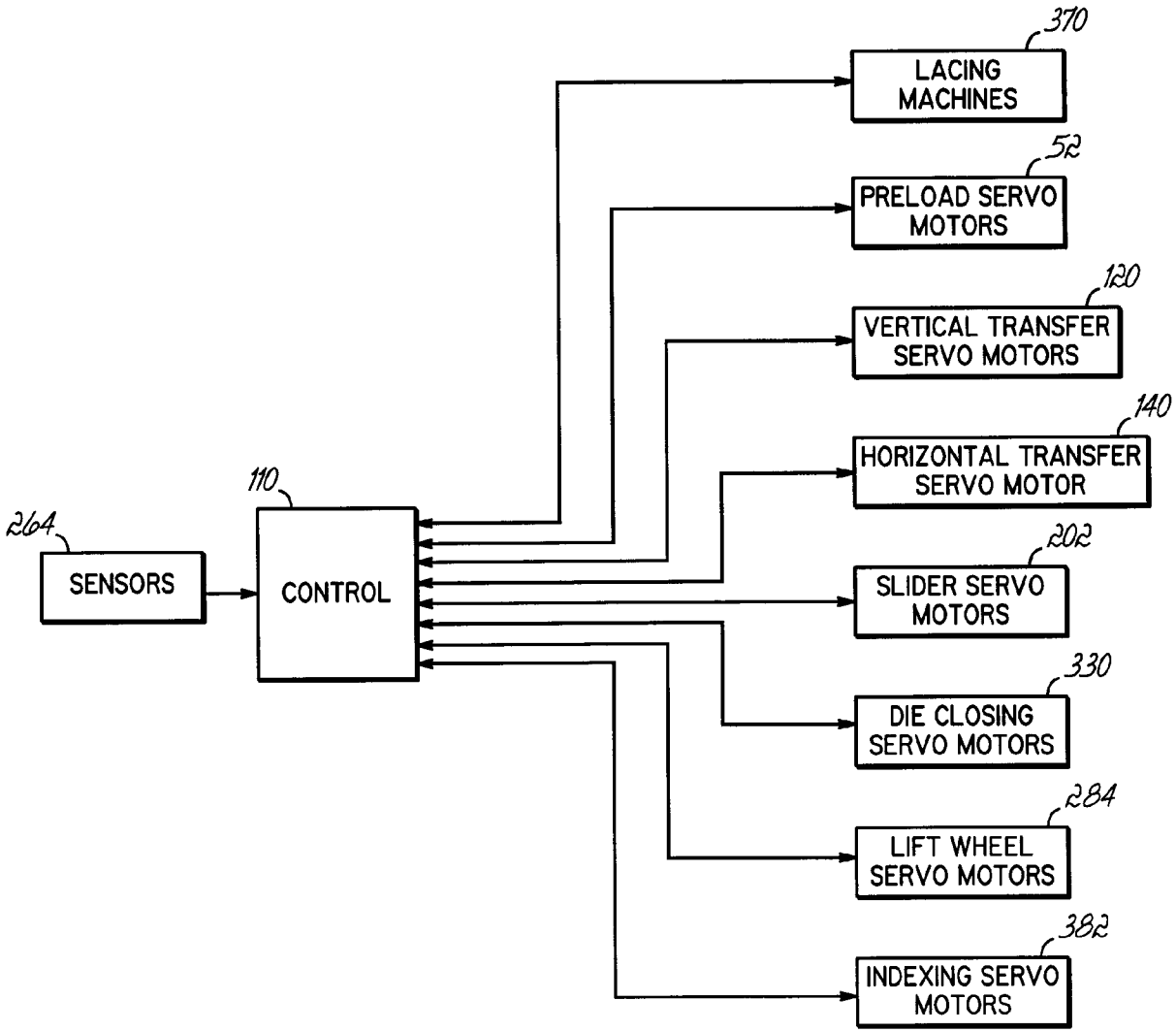
FIG. 19 is a schematic block diagram of a control system of the spring coil assembly machine of FIG. 1.

Referring to FIG. 1, the preloader 30 is mounted for linear motion on a pair of vertical guides 50. A preloader drive 51 has a pair of preloader servomotors 52, for example, Ser. No. 10-17-478 commercially available from Baumuller LNI, Inc. of Bloomfield, Conn., which are electrically connected to a control 110 (FIG. 19). The control 110 is a commercially available programmable logic controller. The servomotors 52 are connected to respective crank arms 54 that, in turn, are pivotally mounted to one end of respective connecting rods 56. The opposite end of the connecting rods 56 is pivotally mounted to the preloader 30. Thus, as the servomotors 52 rotate the crank arms 54, the preloader 30 is moved in a vertical direction along the guides 50. The preloader 30 includes a spline shaft 58 that is rotatably mounted at its ends. Workholders are comprised of magazines 62 mounted on a series of cars 60 that are slidably mounted on the spline shaft 58. Each of the magazines 62 has a pair of opposed grippers 64.

Figure 3:
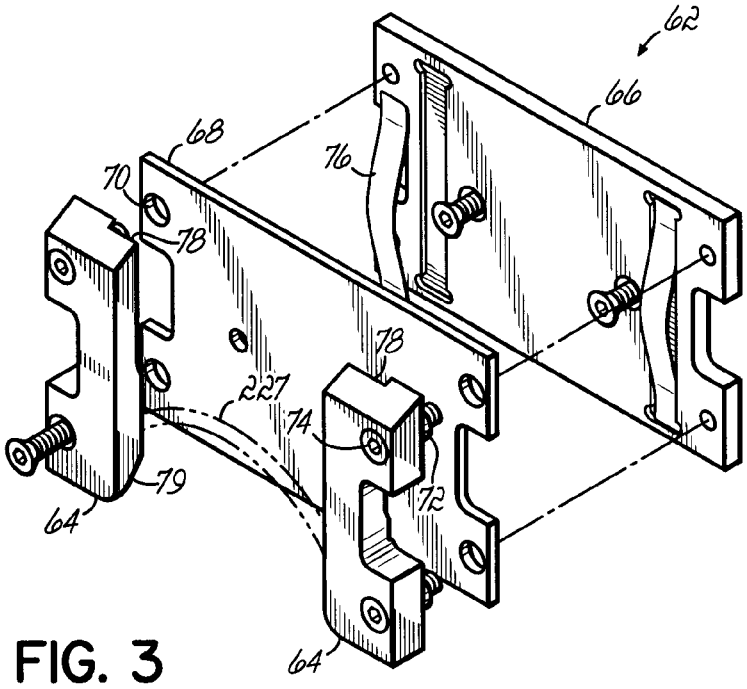
FIG. 3 is a disassembled view of a magazine used with the spring coil assembly machine of FIG. 1.

Referring to FIG. 3, the grippers 64 are rigidly mounted to a base plate 66. A compression plate 68 is interposed between the grippers 64 and the base plate 66. The compression plate has holes 70 that slide over shoulders 72 of the fasteners 74 connecting the grippers 64 to the base plate 66. Thus, the compression plate 68 is movable with respect to the grippers 64 and base plate 66 over the length of the shoulders 72. Biasing elements 76, for example, leaf springs, are mounted between the base plate 66 and the compression plate 68 and resiliently bias the compression plate 68 against the grippers 64. Each of the grippers 64 has an inner directed cutout or notch 78. The notch 78 has a depth less than a diameter of the coil wire and provides a lateral guide of a path for a coil end turn across the magazine 72. The grippers 64 further have respective reliefs or chamfers 79 that guide an end turn of a coil 227 into the notches 78 and permits the magazine 72 to more readily receive an end turn of the coil.

To transfer a row of coil springs from the feed conveyor 28 to the preloader 30, the servomotors 52 are activated to rotate the crank arms 54. The crank arms 54 initially rotate toward a lowermost six o'clock position and lower the preloader 30. As the magazines 62 are lowered, the gripping fingers 64 are pushed toward and over end turns of the coil springs. Referring to FIG. 3, a portion of a coil end turn is received by the reliefs 79 and pushed into respective notches 78 of the grippers 64. As the portion of the end turn is pushed into the notches 78, the compression plate 68 is moved toward the base plate 66. The portion of the end turn is now captured and secured between the grippers 64 and the compression plate 68 by biasing forces of the leaf springs 76. Referring back to FIG. 1, as the crank arms 54 rotate past the six o'clock position, the preloader 30 elevates, thereby lifting, the row of coil springs from the feed conveyor 28. It should be noted that the preloader 30 also has counterbalance weights 57 that are connected to the preloader 30 by chains, wire or other flexible connecting links (not shown).

Figure 4:
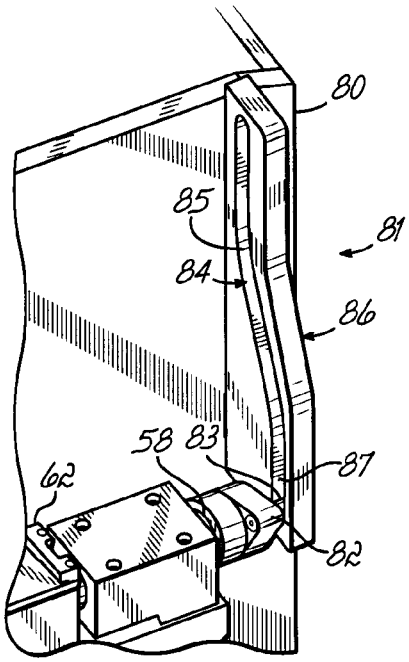
FIG. 4 is a partial perspective view of a crank arm controlling motion of a preloader of the spring coil assembly machine of FIG. 1.

The row of coils has the same generally horizontal orientation that it had in the feed conveyor 28; however, before the row of coils is loaded into the die boxes 33 of the spring coil assembly machine 20, it must be reoriented, so that the centerlines of the coils are generally vertical. Referring to FIG. 4, a preloader pivoting mechanism 81 is used to rotate the magazines 62 approximately 90°. At one end of the spring coil assembly machine, for example, the right end 80 as viewed in FIG. 1, the spline shaft 58 is connected to a crank arm 82 having a cam follower 83 that rides in a cam track 84 within the plate 86. As the preloader 30 moves upward, the cam track 84 has an angular portion 85 that moves the crank arm 82 toward the rear of the spring coil assembly machine 20. That action of the crank arm 82 causes the spline shaft 58, cars 60, magazines 62 and first row of coils to rotate approximately 90°, thereby changing the orientation of the first row of coils within the magazines 62 from horizontal to vertical.

Figure 5:
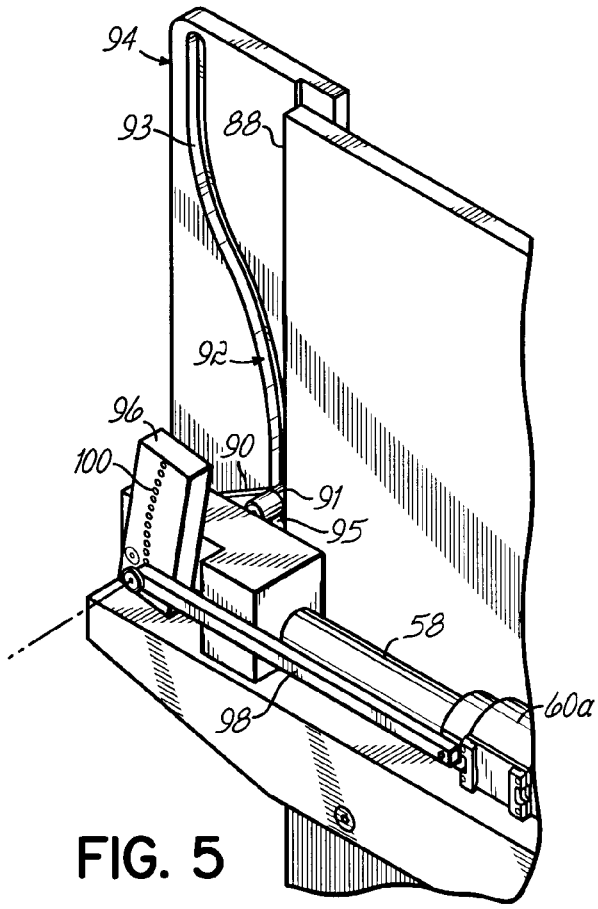
FIG. 5 is a partial perspective view of a crank arm for controlling a further motion of the preloader on the spring coil assembly machine of FIG. 1.

Referring to FIG. 5, at an opposite end 88 of the spring coil machine 20, the spline shaft 58 is connected to a second crank arm 90 having a cam follower 91 on its end that rides in a cam track 92 on plate 94. When the row of coils is picked up from the feed conveyor, the cars 60 are located on the spline shaft 58 with a spacing that matches the pitch, that is, separation, of coils on the feed conveyor 28. However, the laced rows of coil springs may have different widths depending on a desired width of a final product. Therefore, in moving the row of coil springs into the coil spring assembly machine 20, it is necessary to adjust the pitch or spacing of the cars 60 on the spline shaft 58 so that the coils in the row of coil springs in the magazines 62 have a desired spacing or pitch to match that of the finished product. To vary the pitch of the cars 60, the crank arm 90 is connected via a shaft (not shown) to a pivot arm 96. A connecting rod 98 is connected at one end to the pivot arm 96 and at an opposite end to a first one of the cars 60*a*. If the one end of the connecting rod 98 is connected to the pivot arm 96 at its point of rotation, then rotating the crank arm 90 will not move the connecting rod 98. In that situation, the coils in the rows of coils will be loaded on the coil spring assembly machine 20 with the same pitch as they are received from the feed conveyor 28.

Any adjustment to pitch or distance between the coils must be related to the pitch of the helical lacing wire because the coils must always be positioned so that the helical lacing wire always wraps around the lacing legs of the top and bottom turns of the coils. Therefore, any change of pitch of the coils must be in fixed increments corresponding to the pitch of the lacing operation. To achieve that adjustment, the pivot arm 96 has a plurality of holes 100 wherein each hole represents a change of coil spacing in increments of lacing pitch. For example, a first lower hole determines a first short radius and represents a car or coil spacing of one lacing pitch. A second higher hole determines a second, longer radius and represents a car or coil spacing of two lacing pitches, etc. To achieve a change in coil pitch, the one end of the connecting rod 98 is mounted at a selected one of the holes 100. Therefore, as the crankarm 90 rotates the pivot arm 96 counterclockwise, the connecting rod 98 moves to the left, thereby pulling the cars 60 to the left.

Figure 6A:
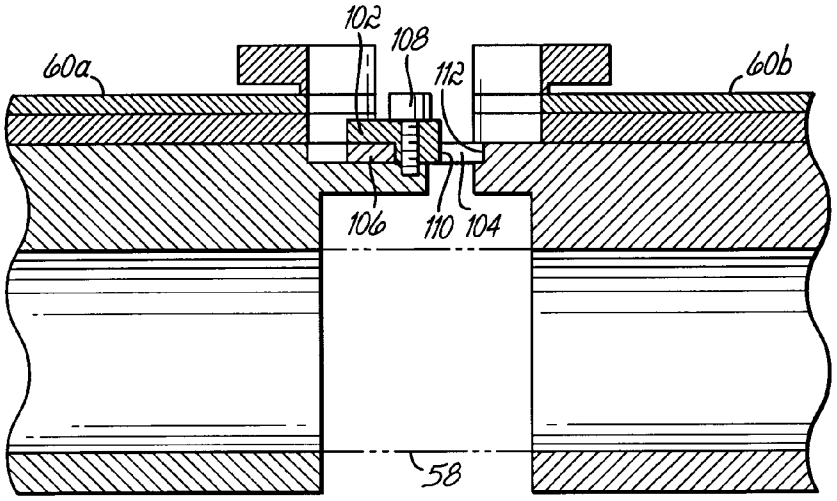
FIG. 6A is a cross-sectional view taken along line 6A—6A of FIG.6 and illustrates how the cars move relative to each other.
Figure 6:
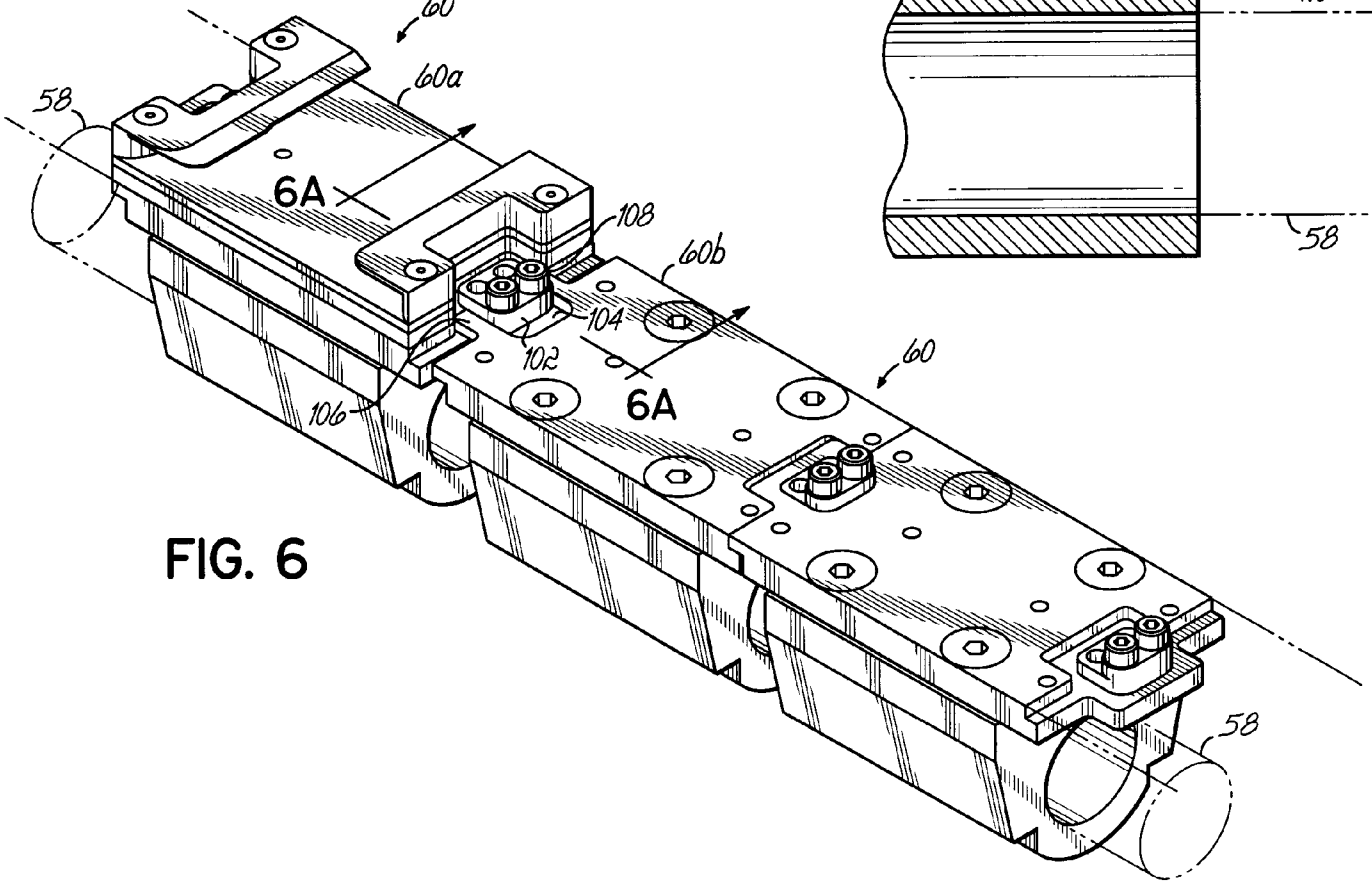
FIG. 6 is a partial perspective view of preloader cars on the spring coil assembly machine of FIG. 1.

Referring to FIGS. 6 and 6A, the cars 60 are connected together in a manner as illustrated by cars 60*a* and 60*b*. A spacer 102 extends through an opening 104 in a tongue 106 of car 60*b* and is connected to car 60*a* via a fastener 108. Thus, car 60*a* can be separated from car 60*b* by a displacement represented by the distance between the end 110 of the spacer 102 and the wall 112 of the opening 104. Further, that distance provides a car and coil spacing that is equal to the lacing pitch. Therefore, as the crank arm 90 moves its cam follower through the angled portion 93 of the cam track 92, the pivot arm 96 rotates; and connecting rod 98 pulls the first car 60*a* to the left. When the car 60*a* moves through an increment permitted by the spacer 102, car 60*b* begins to move. When the crank arm 90 has moved to the end of the angled portion 93, all of the cars 60 will have been moved through the displacement permitted by their respective spacers 102. Thus, when the crank arms 54 (FIG. 1) reach a twelve o'clock position, the row of coils is vertically oriented; and the coils within the row are spaced horizontally to match the desired width of the final product.

As will be appreciated, every time that the connecting rod 98 is connected to a different hole 100 in the pivot arm 96, a different set of spacers 102 must be mounted on the cars 60. It should also be noted that the spacer 102 can be removed and inverted; the cars 60*a*, 60*b* pushed together; and the spacer 102 placed in the opening 104 and fastened to the car 60*a*. In this orientation, the spacer 102 fills the opening 104; and the cars 60*a*, 60*b* are closely locked together.

Transfer Mechanism

Figure 7:
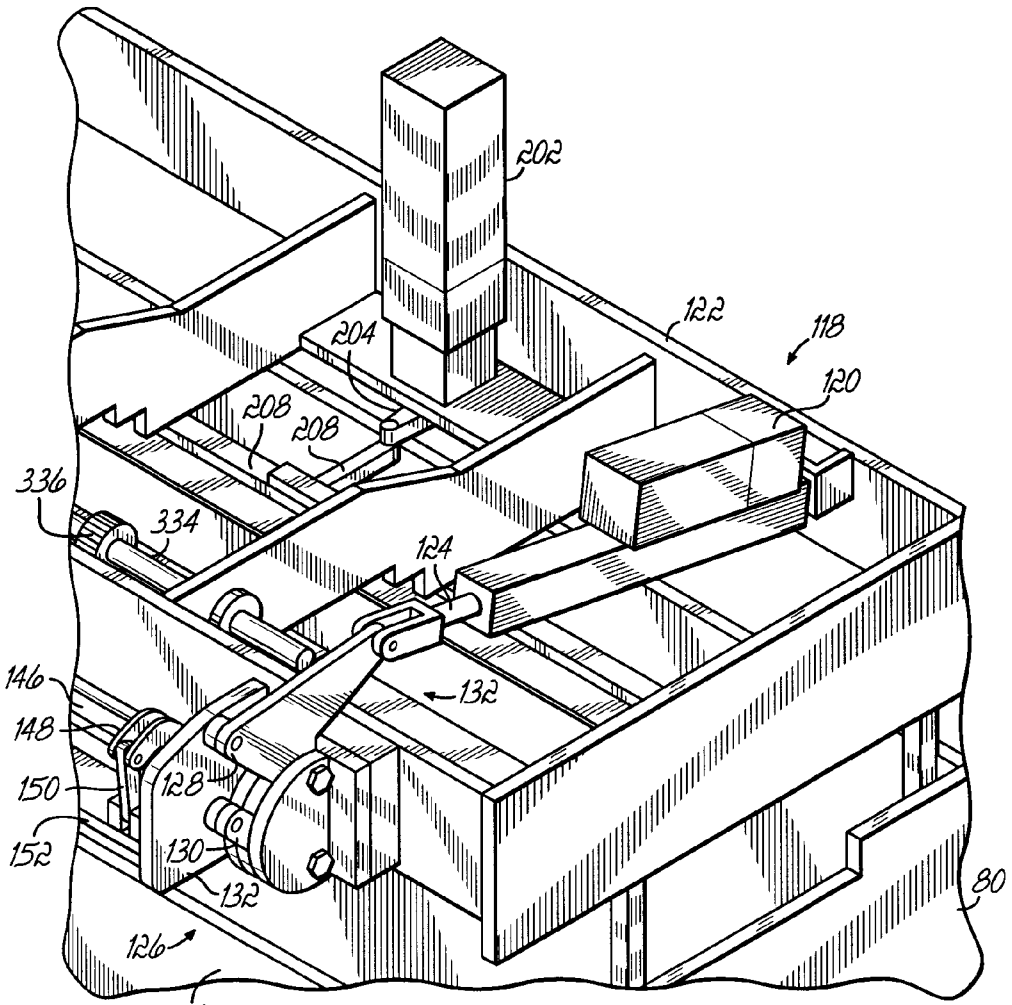
FIG. 7 is a partial perspective view of a vertical transfer servomotor drive used on the spring coil assembly machine of FIG. 1.

Referring to FIG. 1, the transfer mechanism 32 is raised and lowered by a pair of vertical transfer drives 118 that are located at the ends of the transfer mechanism 32. Each of the drives is identical in construction, and therefore, only one of the vertical transfer drives will be described in detail. Referring to FIG. 7, each of the vertical transfer drives 118 has a vertical transfer servomotor 120, for example, model no. 552407 commercially available from Baumuller LNI, Inc. of Bloomfield, Conn., which is electrically connected to the control 110 (FIG. 19). The servomotor 120 (FIG. 7) is pivotally mounted to an upper frame 122 of the coil spring assembly machine 20. Operation of the servomotor 120 extends and retracts a drive shaft 124. The drive shaft 124 is pivotally connected to a four bar linkage 126 that functions to raise and lower the transfer mechanism 32 in response to respective retraction and extension of the drive shaft 124. The four bar linkage 126 is comprised of a pair of parallel links 128, 130 having one end pivotally connected to the upper frame 122. Opposite ends of the parallel links 128, 130 are pivotally connected to end plates 132 of the transfer mechanism 32. The drive shaft 124 is pivotally connected to the link 128. As the drive shaft 124 extends and retracts, the pusher bar 152 is moved substantially vertically down and up.

Referring to FIGS. 1 and 8, a horizontal transfer drive 138 includes a horizontal transfer servomotor 140 that is the same as the servomotor 120 and is about centrally mounted within the transfer mechanism 32. An output shaft 142 of the motor 140 is mechanically connected via gears 144 to a drive shaft 146. The drive shaft 146 extends the full length of the transfer mechanism, and the drive shaft 146 is rotationally supported over its length within the transfer mechanism 32. A plurality of drive links 148 are spaced along the drive shaft 146. One end of each of the drive links 148 is rigidly connected to the drive shaft 146, and an opposite end terminates with a clevis that is pivotally connected to one end of a connecting link 150. The opposite end of the connecting link 150 is pivotally connected to a pusher bar 152. Thus, rotating the servomotor 140 in one direction causes the pusher bar 152 to move along a generally horizontal path from the front toward the rear of the coil spring assembly machine 20. Reversing the rotation of the servomotor 140 causes the pusher bar 152 to move from the rear toward the front of the coil spring assembly machine 20.

As the preloader servomotors 52 raise the preloader 30, the vertical transfer servomotors 120 lower the transfer mechanism 32 to its lower-most position. As shown in FIG. 8, as the preloader 30 moves upward, a top turn 164 of the coil 278 contacts a compression surface 162 on the lowered and stationary transfer mechanism 32. The top turn 164 is also substantially coplanar with an upper receiving surface 166. Continued upward motion of the preloader 30 compresses the coil 278 until its bottom turn 156 is substantially coplanar with a lower receiving surface 160. The horizontal transfer servomotor 140 is then operated to cause the pusher bar 152 to move in a generally horizontal direction toward the rear of the coil spring assembly machine 20, that is, to the right as viewed in FIG. 8. The pusher bar 152 contacts the coil 278 and pushes the coil 278 through the notches 78 (FIG. 3) of the grippers 64 and across the compression plate 68. The pusher bar 152 pushes the coil 278 out of the magazine 62, between the surfaces 160,166 and into the upper and lower die boxes 34, 36. As will be appreciated, while the above describes only one coil 278, the same operation is simultaneously occurring with each coil in the row of coils.

Slider/Lifter

Figure 9:
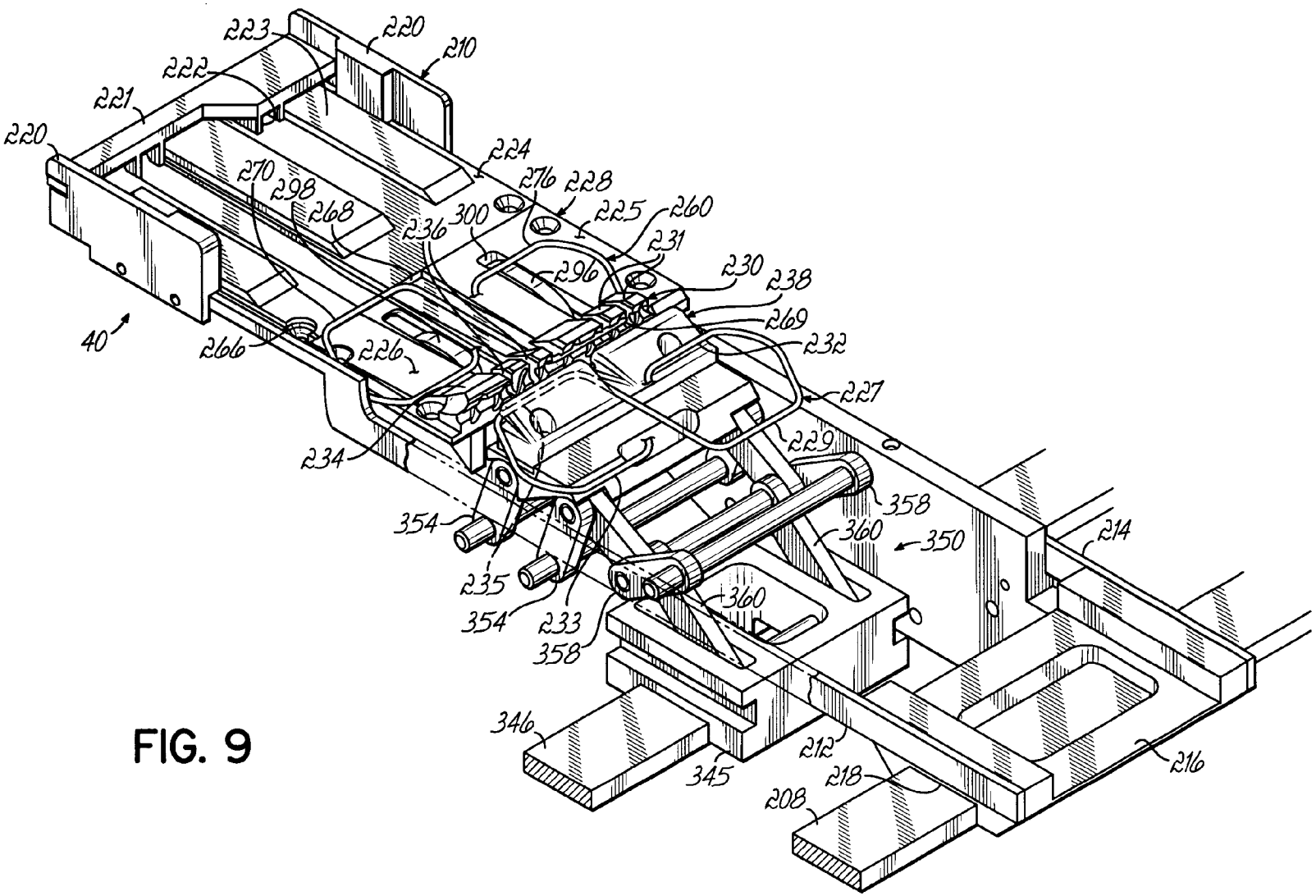
FIG. 9 is a perspective view of a slider mechanism used within a die box of the spring coil assembly machine of FIG. 1.

The pusher bar 152 pushes the coil 278 between the upper and lower die boxes 34, 36 into respective upper and lower slider mechanisms 38, 40. Each of the slider mechanisms 38, 40 is identical in construction; and therefore, any of the following description that refers to one of the slider mechanisms also applies to the other slider mechanism. The servodrive for the slider mechanisms 38, 40 will be described with respect to the upper slider mechanism. The upper slider mechanism 38 is operated by a slide drive mechanism 200 (FIG. 1) that has a pair of slider servomotors 202, for example, model 10-17-474 commercially available from Baumuller LNI, Inc. of Bloomfield, Conn., which are electrically connected to the control 110 of FIG. 19. Referring to FIG. 8, each of the slider servomotors 202 has a crank arm 204 connected to its output shaft. A drive link 206 has one end pivotally connected to the crank 204 and an opposite end pivotally connected to a drive bar 208. Thus, rotation of the servomotors 202 cause the drive bar 208 to reciprocate through a linear displacement between the front and rear sides of the coil spring assembly machine 20. Referring to FIGS. 8 and 9, the drive bar 208 extends through all of the upper die boxes 34 across the width of the coil spring assembly machine 20.

Within each of the upper die boxes 34, a slider 210 is connected to one end of rails 212, 214 that extend over the length of the upper die box 34. A slider drive bracket 216 is connected to the opposite ends of the rails 212, 214. The slider drive bracket 216 has a generally U-shaped notch 218 that has a cross-sectional shape that is similar to the cross-sectional shape of the drive bar 208. The drive bracket 216 is positioned on top of the drive bar 208. Thus, as the slider servomotors 202 rotate in one direction that moves the slider bar 208 toward the rear of the spring coil assembly machine, the slider bar 208 pulls the slider 210 toward the rear of the spring coil assembly machine 20. Similarly, rotation of the slider servomotors 202 in an opposite direction causes the slider bar 208 to push the slider 210 toward the front of the machine 20.

Referring to FIG. 2, each coil has an upper end turn 240 and a lower end turn 242 that are interconnected by at least one intermediate turn 244. Each of the upper and lower end turns 240, 242 have respective lacing legs 246, 248 and respective short legs 250, 252. Each of the coils has a centerline 254 that is substantially perpendicular to the end turns 240, 242, and the lacing legs 246, 248 are located at a further distance from a coil centerline 254 than the short legs 250, 252. The lacing legs and short legs are alternated with successive coils along the row of coils. Thus, when upper and lower helical lacing wires 256, 258 are wound past the rows of coils, for example, rows of coils 21, 22, the lacing wires 256, 258 wrap around the further extending respective lacing legs 246, 248 but do not wrap around the short legs 250, 252.

Referring to FIG. 9, the slider 210 includes projecting fingers 222 that extend to a landing surface 224 of the slider 210. The pusher bar 152 (FIG. 8) pushes the coil 278 between the upper and lower die boxes 34, 36, over the top 221 of the slider 210 (FIG. 9) until the bottom turn of the coil drops onto risers 223 immediately in front of the slider 210. The risers 223 provide a landing plane above the landing surface 224 and reduce the magnitude of the coil drop off of the surface 221. Thereafter, simultaneous operation of the slider servomotors 202 (FIG. 8) for both the upper and lower slider mechanisms 34, 36 (FIG. 8) cause respective sliders 210 to push top and bottom turns of each coil in a row of coils downstream toward the respective upper and lower sets of dies 38, 40. For purposes of this document, the term "upstream" refers to a direction or location that is toward, or closer to, the forward side 27 of the spring coil assembly machine 20 and away, or further, from the rear of the spring coil assembly machine 20. Likewise, "downstream" refers to a direction or location that is toward, or closer to, the rear of the spring coil assembly machine 20 and away, or further, from the front of the spring coil assembly machine 20.

Figure 10:
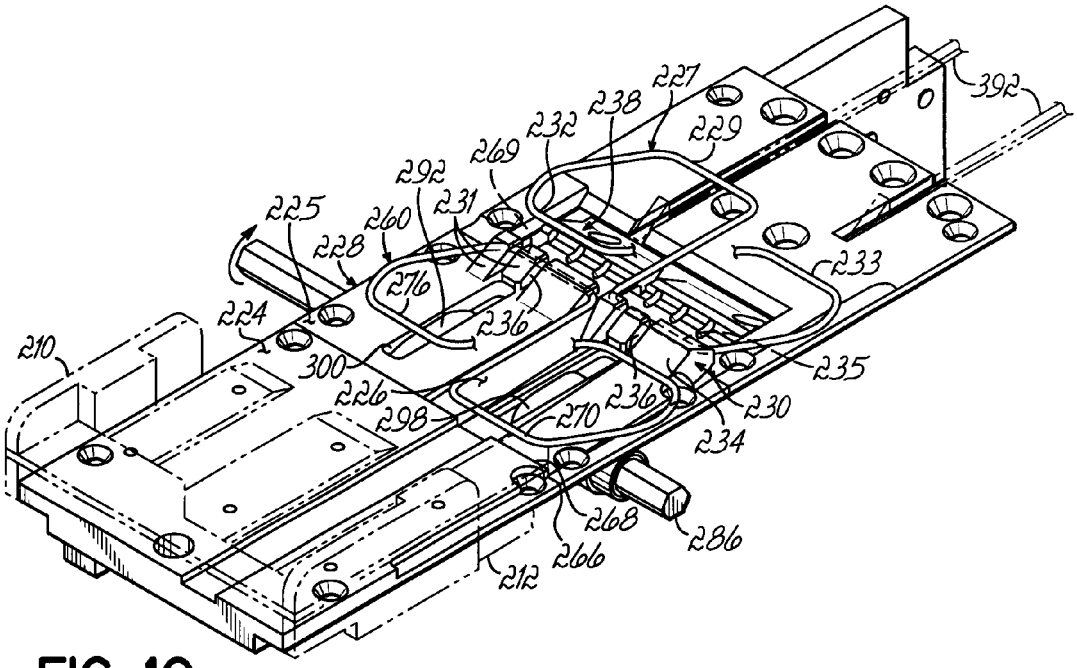
FIGS. 10–14 are partial perspective views of a coil spring stacking operation on the spring coil assembly machine of FIG. 1.

An operation of a single slider 210 is illustrated and described with respect to FIGS. 9 and 10 and is illustrative of the operation of all of the sliders. The slider servomotor 202 is operated to cause the slider 210 to push a first coil 227 of the first row of coils across the landing surface 224 and onto the upstream surface 228 of a stationary front die 230. As the first coil 227 is pushed over the surface 228, a downstream lacing leg 229 rides up inclined surfaces 231 on the rear of the front die 230 thereby causing an upstream short leg 232 to rise. Simultaneously therewith, a downstream short leg 233 contacts and rides up inclined surfaces 234, thereby lifting an upstream lacing leg 235. As the upstream legs 232, 235 rise with the elevating downstream legs 229, 233, the slider 210 is maintained in contact with the upstream legs 232, 235 by the slider fingers 222. Continued downstream motion of the slider 210 pushes the coil 229 up and over the front die 230. The slider fingers 222 then pass through the slots 236 to the end of its downstream displacement or stroke. At the end of the downstream stroke of the slider 210, the upstream lacing leg 235 drops immediately downstream of the stationary front die 230; and entirety of the coils 227 of the first row of coils 21 (FIG. 2) are located downstream of the stationary front die 230 as illustrated in FIG. 10. The rotation of the motors 202 of the upper and lower slider mechanisms 38, 40 continues until all of the sliders 210 have been returned to their starting upstream positions. As the sliders 210 begin to move to their respective home positions, the movable rear die 238 is moved toward the front die 230 to a partially closed position. The details of the operation of the movable rear die will be subsequently described.

Thereafter, the pusher bar 152 (FIG. 8) of the transfer mechanism 32 places a second row of coils on the landing surface 224 as represented by a second coil 260 in FIG. 10. Again, the slider motors 202 (FIG. 8) are operated to move the slider 210 downstream through a second displacement or stroke. The slider 210 pushes the second coil 260 over the landing surface 224 and onto the upstream surface 228. The upstream surface 228 is divided into two halves. A first surface 225 is substantially coplanar with the landing surface 224. An adjacent second portion or surface 226 has an upstream edge 266 that is lower than a downstream edge 268 of the landing surface 224. The distances between the edges 266 and 268 is slightly greater than the diameter of the wire used to form the continuous coils. Thus, an uppermost surface of the upstream lacing leg 270 is at or slightly below the plane of the landing surface 224. The second surface 226 inclines upward as it extends downstream to the stationary die 230. Thus, the downstream edge of the second surface 226 is substantially co-linear with a comparable downstream edge of the first surface 225.

Therefore, as slider 210 pushes the second coil 260 over the upstream surface 228, a downstream lacing leg 269 rides up the inclined surfaces 231 and over the stationary front die 230 as previously described with respect to the first coil 227. When the slider 210 reaches the end of its second stroke, the downstream lacing leg 269 is dropped over the downstream edge of the front die 230. The operation of the slider servomotors 202 is then reversed, and the slider returns to its starting upstream position.

With known coil spring assembly machines, the upper and lower dies 230, 238 in die sets 38, 40 would now be closed and lacing wires fed across the upper and lower die boxes 34, 36. The lacing wires wrap around the upstream lacing legs 235 of the first coils 227 in the first row of coils and the downstream lacing legs 269 of the second coils 260 in the second row of coils, thereby lacing the first and second rows of coils together. However, with known coil spring assembly machines, it is not possible to stack and lace one or more rows of coaxial coils; however, in contrast, the spring coil assembly machine 20 is able to stack and lace rows of coaxial coils. If a coaxial row of coils is desired, referring to FIG. 11, a downstream lacing leg 302 of a third coil 278 representing a third row of coils must be fed beneath an upstream short leg 276 of the second coil 260; and a downstream short leg 304 of the third coil must be fed over the upstream lacing leg 270 of the second coil 260. Referring to FIG. 8, that capability is provided by upper and lower lift wheel mechanisms 280, 282 associated with the respective upper and lower die boxes 34, 36.

Figure 8A:
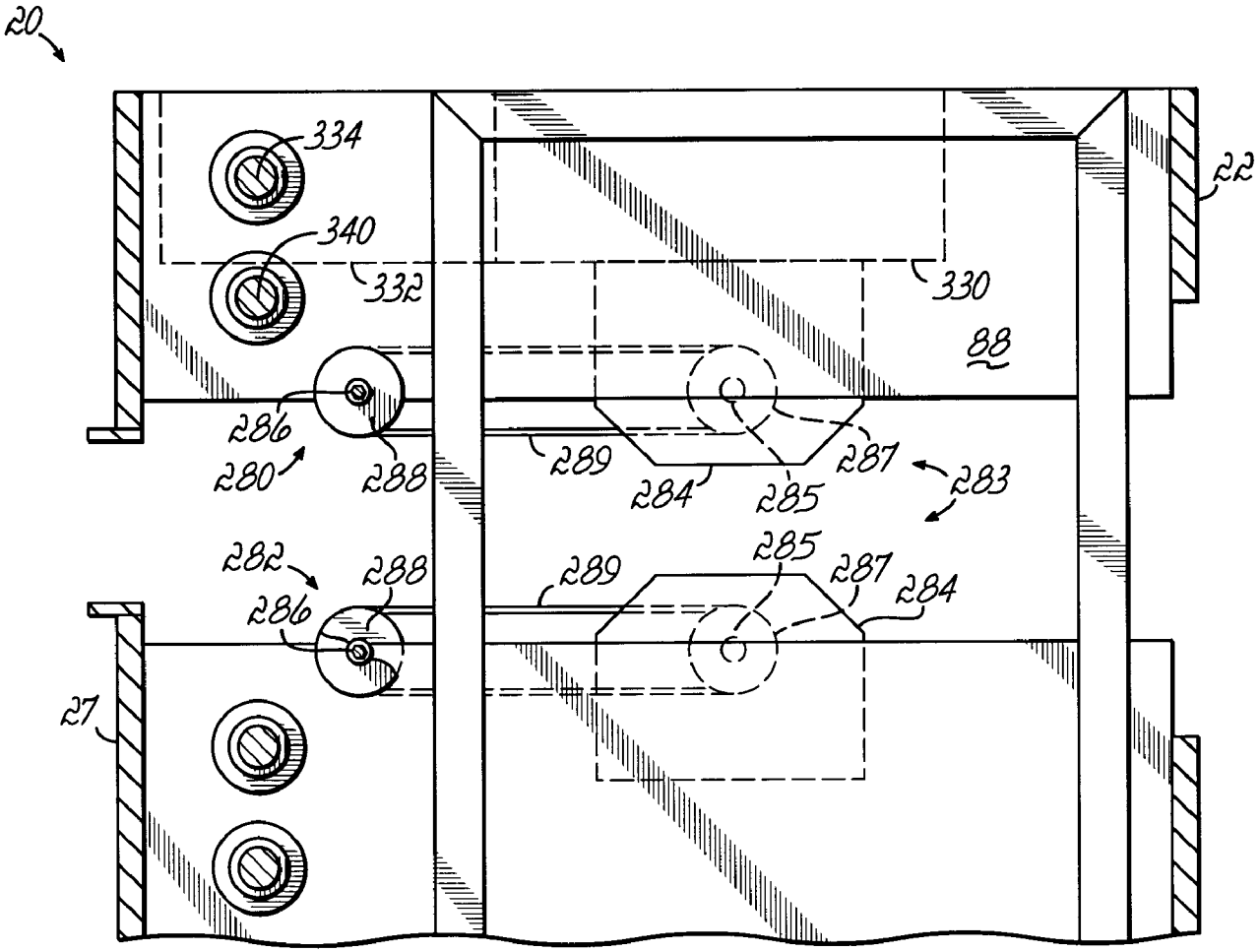
FIG. 8A is a partial cross-sectional view illustrating a lift wheel drive used within the die box of the spring coil assembly machine of FIG. 1.

Referring to FIG. 8A, lift wheel drives 283 include servomotors 284, for example, model no. 10-17-476 commercially available from Baumuller LNI, Inc. of Bloomfield, Conn., which are electrically connected to the control 110 (FIG. 19). The servomotors 284 are mounted to the exterior frame at one end of the coil spring assembly machine 20. The servomotors 284 have output shafts 285 connected via respective pulleys 287, 288 and belts 289 to respective lift wheel drive shafts 286. The lift wheel mechanisms 280, 282 are identical in construction; and therefore, the following description relating to the lower lift wheel mechanism 282 also applies to the upper lift wheel mechanism 280. Referring to FIG. 10, the drive shaft 286 has a noncircular cross-sectional profile, for example, a hexagonal shape. The drive shaft 286 extends through hexagonally shaped centrally located holes 290 in lift wheels 292 that, in turn, are rotatably supported by bearings mounted within the drive box at each end of the lift wheel 292. The operation of the lift wheel 292 in each of the bearing boxes 34, 36 is identical; and therefore, the operation of a lift wheel within a single bearing box will be described.

Figure 11:
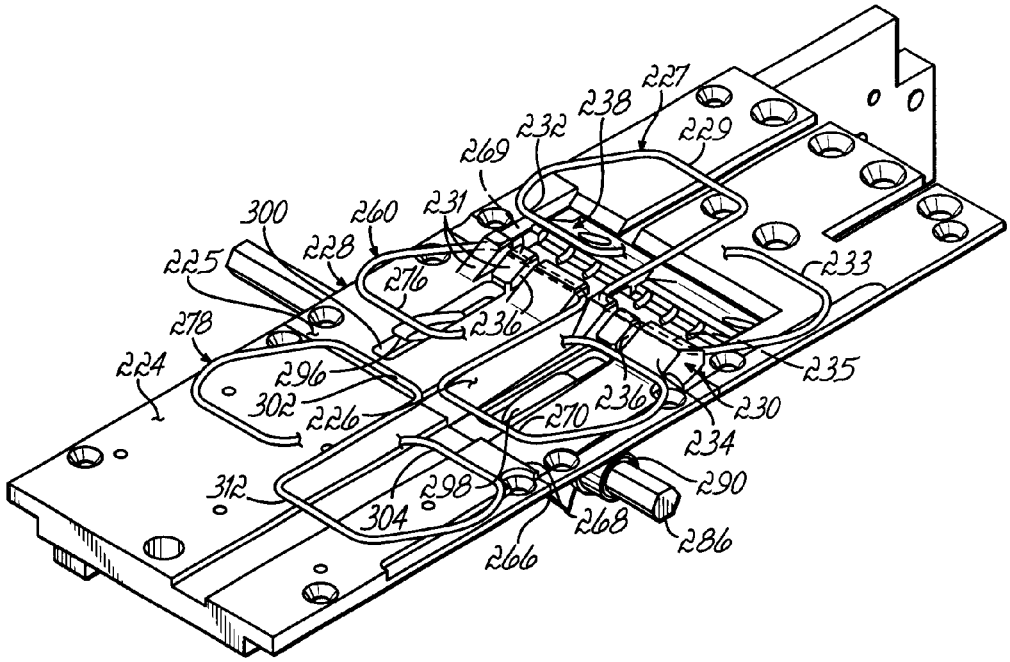
Figure 15:
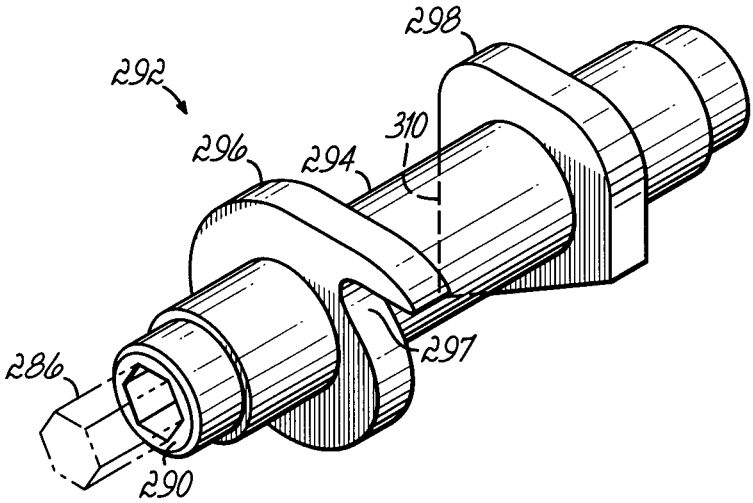
FIG. 15 is a perspective view of a lifter wheel used in the coil spring stacking operation on the spring coil assembly machine of FIG. 1.

Referring to FIG. 15, the lift wheel 292 is comprised of a main body or shaft 294 on which is mounted a lift cam 296 and a stop cam 298. Referring to FIG. 8, in a manner as previously described, a third row of coils represented by coil 278 is loaded by the transfer mechanism 32 onto the landing surface 24; and the slider 210 is operated to push the third row of coils toward the stationary die 230. Referring to FIG. 11, as the third coil 278 is pushed across the landing surface 224, the lift wheel servomotor 284 is operated to rotate the drive shaft 286 and lift wheel 292. The lift wheel 292 starts at its home position (FIGS. 8, 10 and 15) and rotates in a clockwise direction as viewed in FIG. 11. The lift wheel 292 rotates approximately 20° from its home position to move the lift cam 296 through an opening 300 of the first surface 225 of the upstream surface 228. The lift cam 296 lifts the upstream short leg 276 of the second coil 260 above the surface 228. However, the upstream lacing leg 270 of the second coil 260 remains flat against the second surface 226 and below the locating surface 224 because the second row of coil springs is maintained under compression between the upper and lower die boxes 34, 36.

Figure 12:
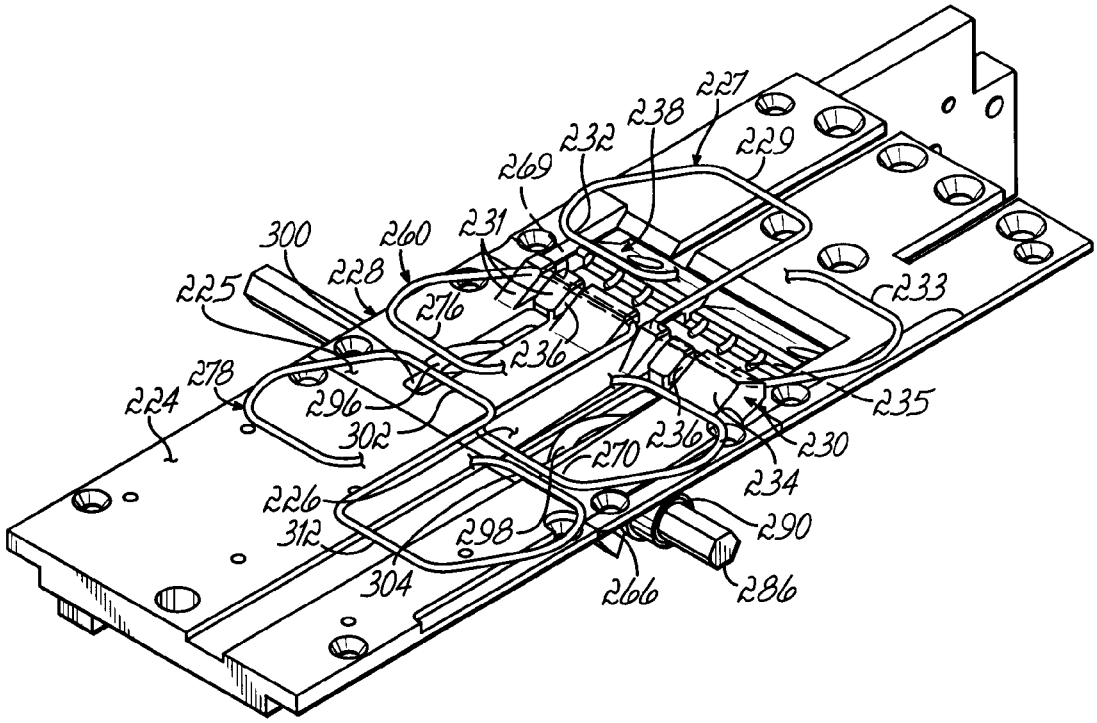
Figure 13:
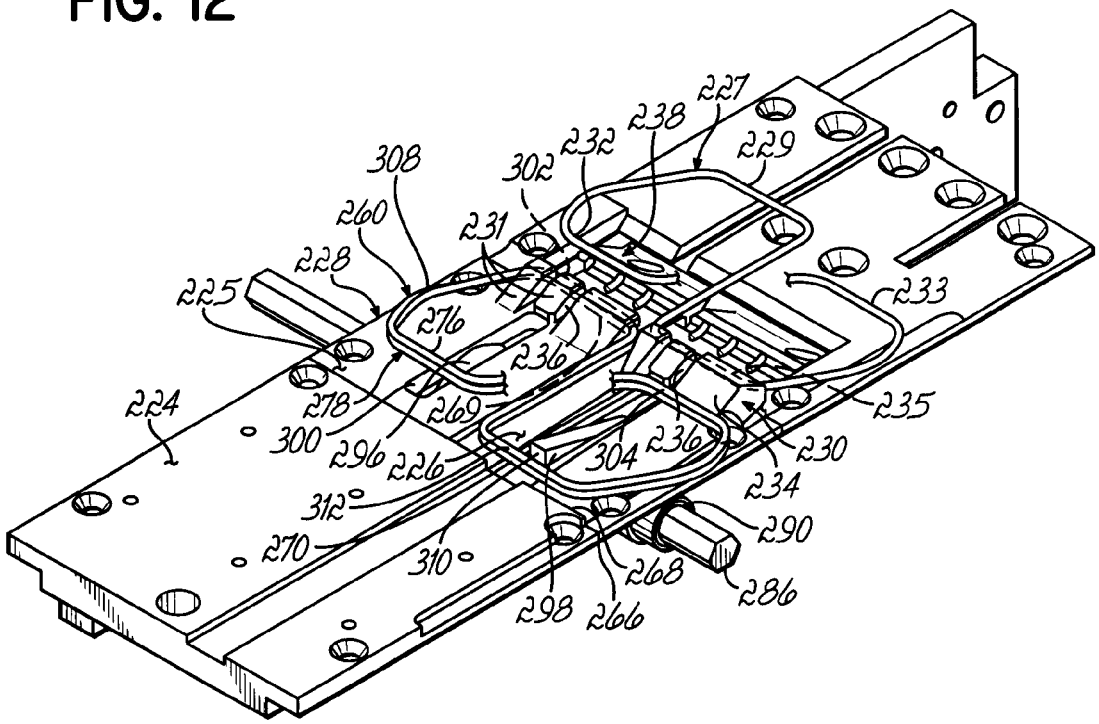

Referring to FIG. 12, as the third row of coils 278 is pushed onto the stationary die upstream surface 228, the downstream lacing leg 302 of the third coil 278 moves into the lift wheel cam slot 297 that is now below the upstream short leg 276 of the second coil 260. Referring to FIG. 13, continued rotation of the lift wheel 292 rotates the lift cam out from under the upstream short leg 276 and back below the first surface 225. As the third coil 278 is pushed further, the downstream short leg 304 of the third coil 278 is pushed over the upstream lacing leg 270 of the second coil. Continued pushing of the third coil 278 causes the downstream lacing leg 302 to slide over the upwardly sloped inclined surfaces 231 on the rear side of the stationary die 230. At the end of the third stroke of the slide 210, the downstream lacing leg 302 of the third coil 278 is located immediately downstream of the front die 230 with the downstream lacing leg 269 of the second coil 260. Further, the upstream lacing leg 312 of the third coil 278 lies over the upstream lacing leg 270 of the second coil 260. It should be noted that pushing the downstream lacing leg 302 (FIG. 12) of coil 278 under the upstream short leg 276 of coil spring 260 and the downstream short leg 304 of coil 278 over the upstream lacing leg 270 of coil spring 260 facilitates a tight nesting of the coil springs 260, 278. Further it also results in a crossover point 308 where the wire of coil 260 crosses from being under coil 278 to being over coil 278. It should be noted that the crossover point 308 may vary from coil to coil within a row of coils. The tight nesting of the coils 260, 278 is facilitated by a crossover of the end turns of the coil, and it is not dependent on a particular crossover point location.

Figure 14:
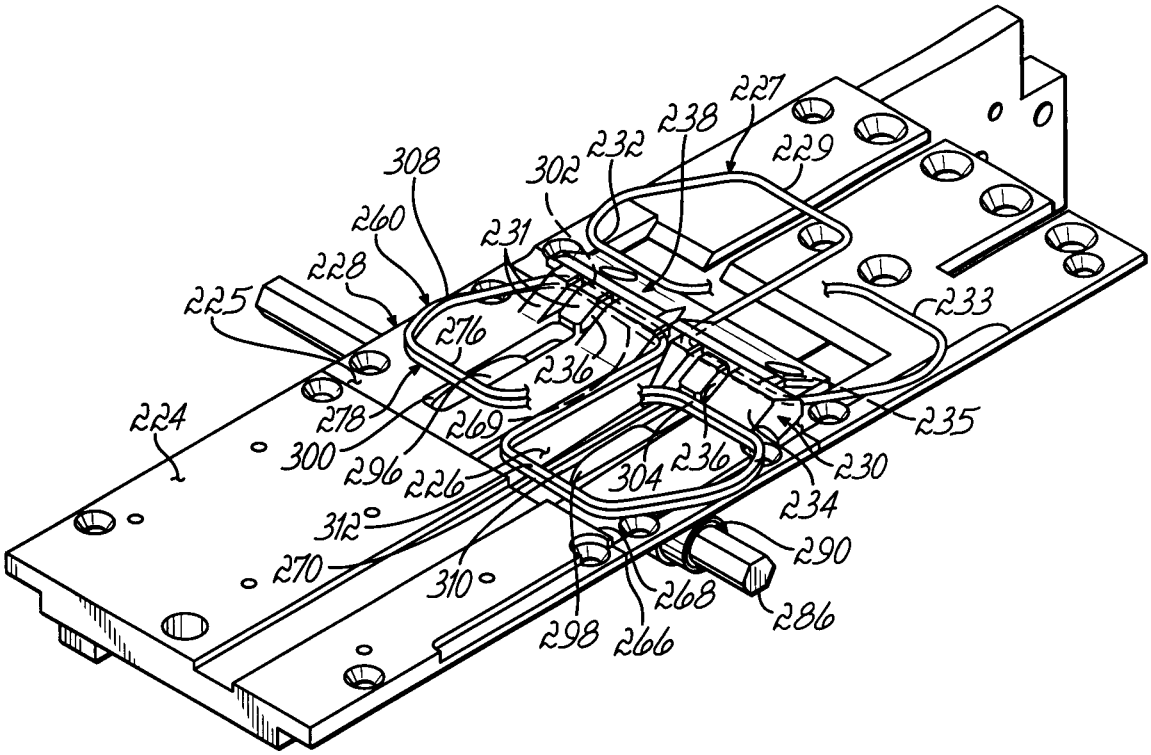

As shown in FIG. 13, continued rotation of the lift wheel 292 approximately 180° from its home position causes the stop cam 298 to extend above the second surface 226 and present a stop surface 310 to the upstream lacing legs 270, 312 of the respective second and third coils 260, 278. The stop surface 310 function to align and maintain the second and third coils 260, 278 in a substantially parallel relationship. The parallel relationship of the second and third coils 260, 278 prevents misalignment of the coils within the dies that might unnecessarily stress and fracture the dies. Referring to FIG. 14, the upper and lower die sets 42, 44 are then closed; and the lift wheel 292 continues its rotation back to its home position, thereby rotating the stop cam 298 back below the second surface 226.

Die Closing

The structure and operation of all the die sets within the upper and lower die boxes 34, 36 are identical; and therefore, an explanation of an operation of a single die set will be applicable to the other die sets. A die closing mechanism 328 (FIG. 8) for the upper die boxes 34 is operated by a die closing servomotor 330 shown in FIG. 1, for example, model no. 10-17-470 commercially available from Baumuller LNI, Inc. of Bloomfield, Conn., which is electrically connected to the control 110 of FIG. 19. The servomotor 330 is connected to a right angle drive 332 that, in turn, rotates a drive shaft 334 extending across the full width of the spring coil assembly machine 20. Referring to FIG. 8, the die closing mechanism 328 further includes a die closing shaft 340 connected to the drive shaft 334 via gears 336, 338. A plurality of crank wheels 342 are mounted on the die closing shaft 340. The structure and operation of all of the die sets is identical and will be described with reference to the upper and lower die boxes 34, 36 as is appropriate. Within the upper die box 34, a connecting arm 344 has one end pivotally connected to the crank wheel 342 and an opposite end pivotally connected to a drive block 345. The drive block 345 is mounted on a die slider bar 346. The die slider bar 346 extends over a substantial length of the assembly machine 20 and is mounted on one or more linear guides 348. Thus, the die slider bar 346 reciprocates back and forth through linear strokes in response to the operation of servomotor 330 and rotation of the crank wheel 342.

Figure 16:
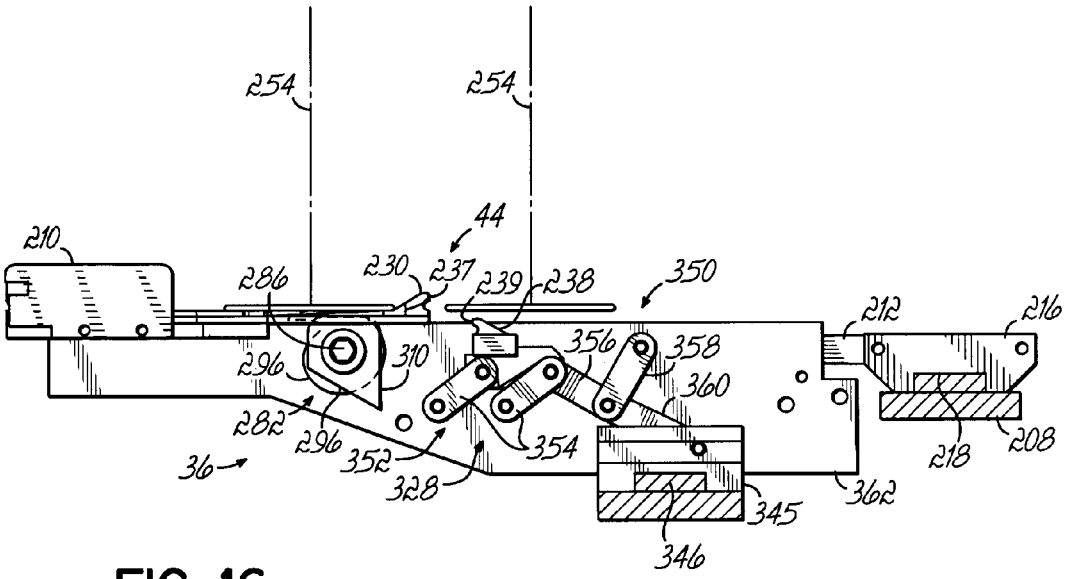
FIGS. 16–18 are side views illustrating the operation of a die closing mechanism used on the spring coil assembly machine of FIG. 1.

FIG. 16 illustrates a lower die box 36 with the die set 44 in its open position. In the open position, the die slider bar 346 is at the downstream end of its linear stroke, and the movable rear die 238 is positioned downstream of, and below, the stationary front die 230. The stationary front die 230 has a planar die face 237 that extends longitudinally in a direction away from the viewer that is substantially perpendicular to the coil centerlines 254. Further, the movable rear die 238 has a planar die face 239 that is substantially parallel to the planar die face 237 of the fixed die 230. The die closing mechanism 328 further has a toggle 350 that operates a four bar link 352. The four bar link has a pair of parallel links 354 that have one end pivotally connected to the mounting structure of the rear die 238 and an opposite end pivotally connected to the lower die box 36. The toggle 350 has a first link 356 pivotally connected at one end to the mounting structure of the rear die 238, and the first link is pivotally connected at an opposite end to one end of a second toggle link 358. The opposite end of the second toggle link 358 is pivotally connected to the lower die box 36. A drive link 360 has one end pivotally connected to the connection between the first and second toggle links 356, 358 and an opposite end pivotally connected to the die slider bar 346.

Figure 17:
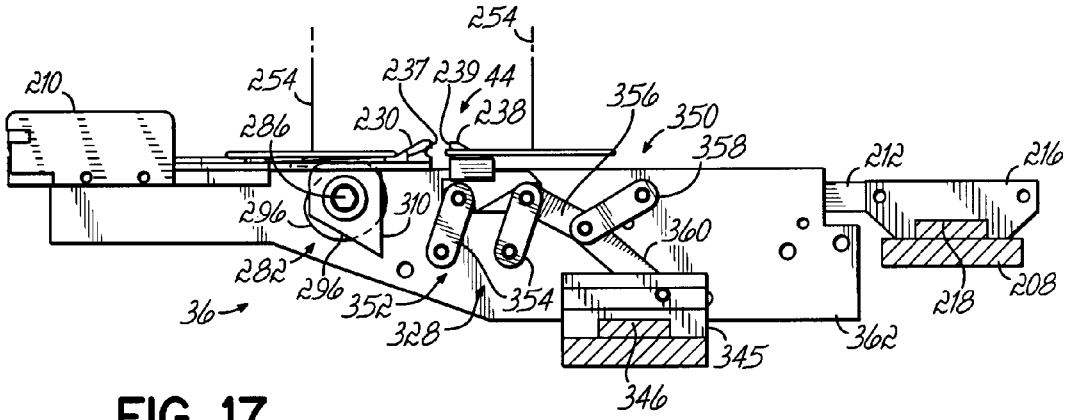

To close the die, the servomotor 330 (FIG. 1) is operated to rotate the first and second drive shafts 334, 340, respectively, (FIG. 8) and the crank wheel 342. The die slider bar 346 (FIG. 16) begins moving toward the left as viewed in FIG. 16. The drive link 360 is also moved to the left and begins to rotate clockwise, thereby beginning to close the toggle 350 formed by toggle links 356, 358. As shown in FIG. 17, the links 354 begin to rotate counterclockwise and function to maintain the movable rear die 238 in a substantially horizontal orientation as it moves upward and upstream toward the stationary die 230. During the motion of the rear die 238 in closing on the front die 230, the planar die faces 237, 239 remain substantially parallel. Operation of the die closing servomotor 330 continues to move the die slider bar 346 to the left, thereby continuing to close the toggle 350. With the die closing mechanism just described, the movable rear die 238 approaches the stationary front die 230 with a nonpivoting action. Further, as the movable rear die 238 moves into a closed position with respect to the stationary front die 230, it is moving substantially linearly toward the die as viewed in FIG. 18. At this point, the centerlines of the toggle links 356, 358 are substantially collinear; the toggle 350 is locked and the operation of the servomotor 330 is stopped. The locked toggle 350 provides a very stiff mechanical support for the movable rear die 238 in its closed position. Further, substantially all of the load force imposed on the movable rear die 238 is reacted through the die box frame 362 and not the die slider bar 346.

Lacing Machine

Figure 18:
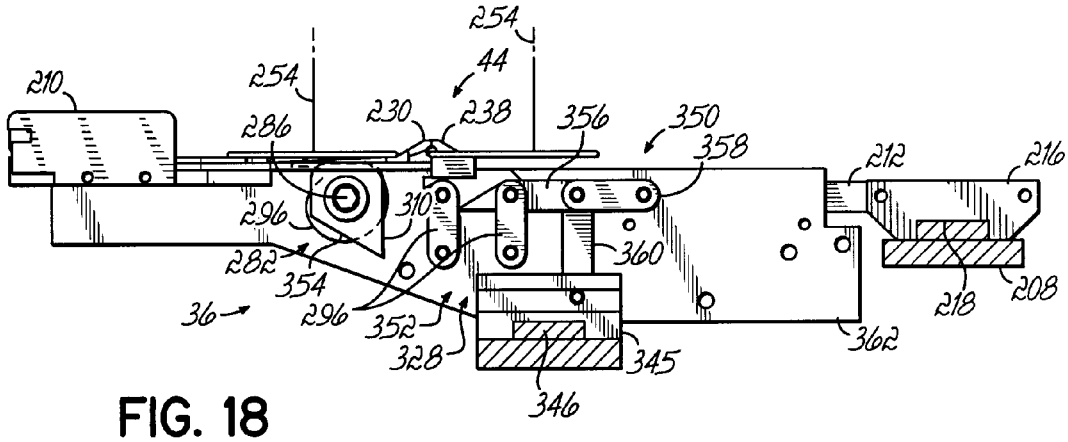

When the lacing dies are closed as shown in FIG. 18, one or more lacing machines 370 (FIG. 2) are operated by the control 110 of FIG. 19. The lacing machines 370 include respective lacing wire forming apparatus of a known type. Such devices take spring wire and coil it into helical lacing coils 256, 258; and thereafter, the lacing machines 370 cause respective lacing coils to wind or lace from one edge of the rows of coil springs held in the dies 230, 238 to the other edge. Such a known lacing operation is described at column 17, line 61 through column 19, line 62 in U.S. Pat. No. 4,492,298 entitled Coil Spring Assembly Machine, and that cited material in its entirety is hereby incorporated herein by reference.

Indexer

Referring to FIG. 8, an indexing mechanism 380 is used to move the laced rows of coil springs through the coil spring assembly machine 20 and operates in conjunction with the upper and lower slider mechanisms 38, 40. The indexing mechanism 380 uses a pair of indexing servomotors 382, for example, Ser. No. 10-17-470 commercially available from Baumuller LNI, Inc. of Bloomfield, Conn., which are electrically connected to the control 110 of FIG. 19. Each of the indexing servomotors 382 is mounted proximate one of the ends 27, 88 (FIG. 1) of the coil spring assembly machine 20. Each of the indexing servomotors 382 is connected to a crank 384 (FIG. 8) that is pivotally connected to one end of a connecting rod 386. The other end of the connecting rod 386 is pivotally connected to a vertical drive plate 387. Vertical drive plates 387 at each end of the assembly machine 20 are connected to ends of upper and lower drive bars 388, 389, respectively, thereby forming a generally rectangular body. The drive plates are mounted in respective linear guides 390 at each end of the assembly machine 20. The linear guides 390 guide and support the assembly of the drive plates 387 and drive bars 388, 389 through a linear motion between the front and rear of the spring coil assembly machine 20. The drive bars 388, 389 are mounted in respective indexing hooks 392.

Figure 20:
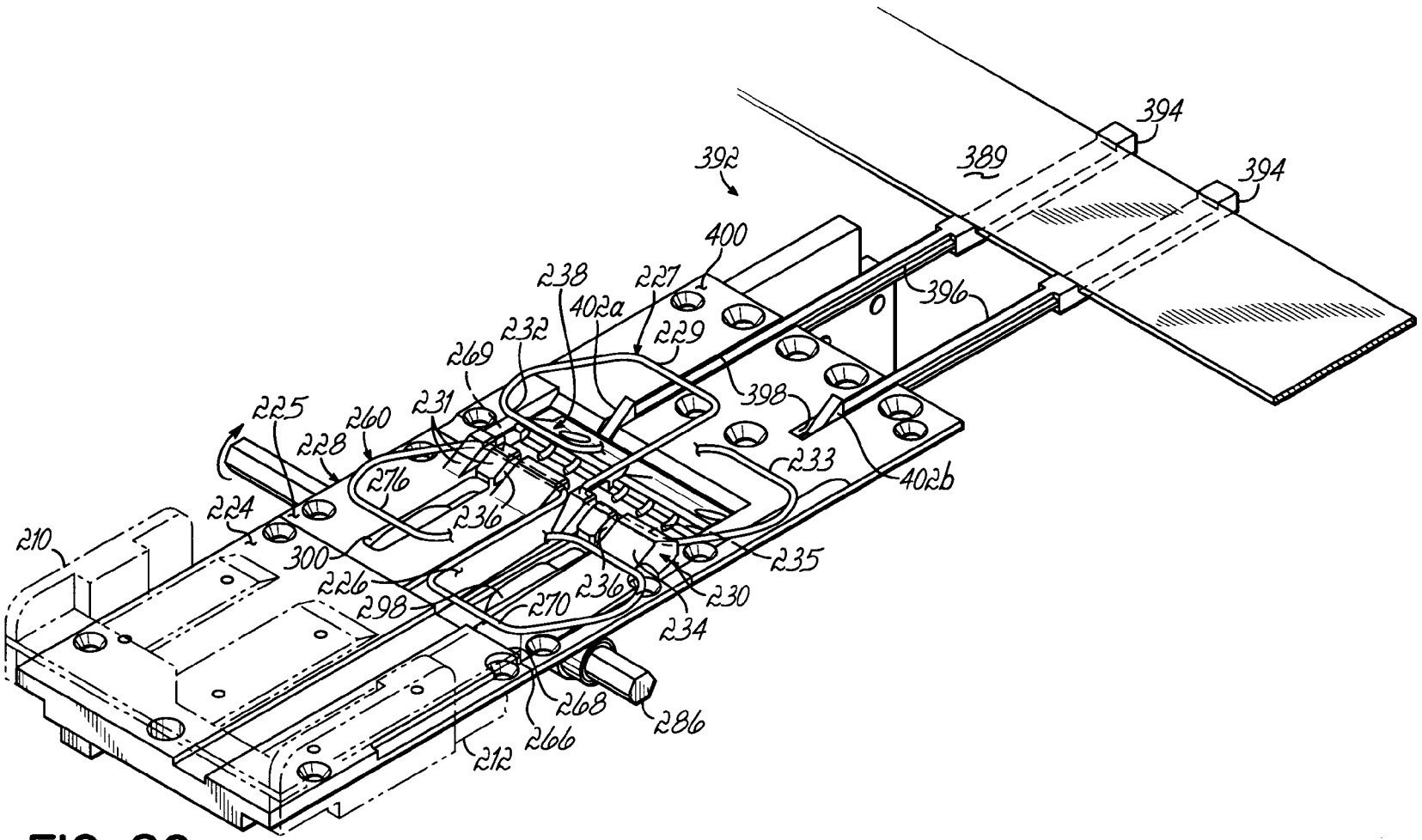
FIG. 20 is a partial perspective view of indexer hooks used to move laced rows of coils through the spring coil assembly machine of FIG. 1.

The operation of the upper and lower drive bars 388, 389 is substantially the same, and the operation of the drive bars in association with the indexing mechanism 380 will be with reference to one or the other of the drive bars. Referring to FIG. 20, a lower indexing hook 392 has a respective drive bracket 394 that is engaged with the lower drive bar 389. The indexing hook 392 is moved by the lower drive bar 389 through a reciprocating linear motion controlled by the indexing servomotors 382 and crank 384. Bars 396 extend from respective ends of the drive bracket 394 into slots 398 of a die plate 400. Hook ends 402*a*, 402*b* of respective bars 396 have a sloped forward or upstream side. Therefore, as the hook ends 402 move toward the front of the machine 20, that is, to the left as viewed in FIG. 20, the hook end 402*a* slides under a lacing leg of a coil, for example, lacing leg 229 of coil 227. Hook end 402*b* is mounted on a shorter bar than the hook end 402*a*; and therefore, with the first row, or border row, of coils, the hook end 402*b* does not engage a coil. When the drive bar 389 moves the indexing hooks 392 and respective hook ends 402 in the opposite direction toward the rear of the machine, the hook end 402*a* of the upper and lower indexing mechanisms 380 pull the laced rows of coils toward the rear of the machine. After the coil 227 is indexed toward the rear of the machine, during subsequent coil indexing operations, the hook end 402*b* slides under a short leg 233 of coil 227; and both hook ends 402*b*, 402*b* function to pull laced rows of coils towards the rear of the machine.

Figure 21:
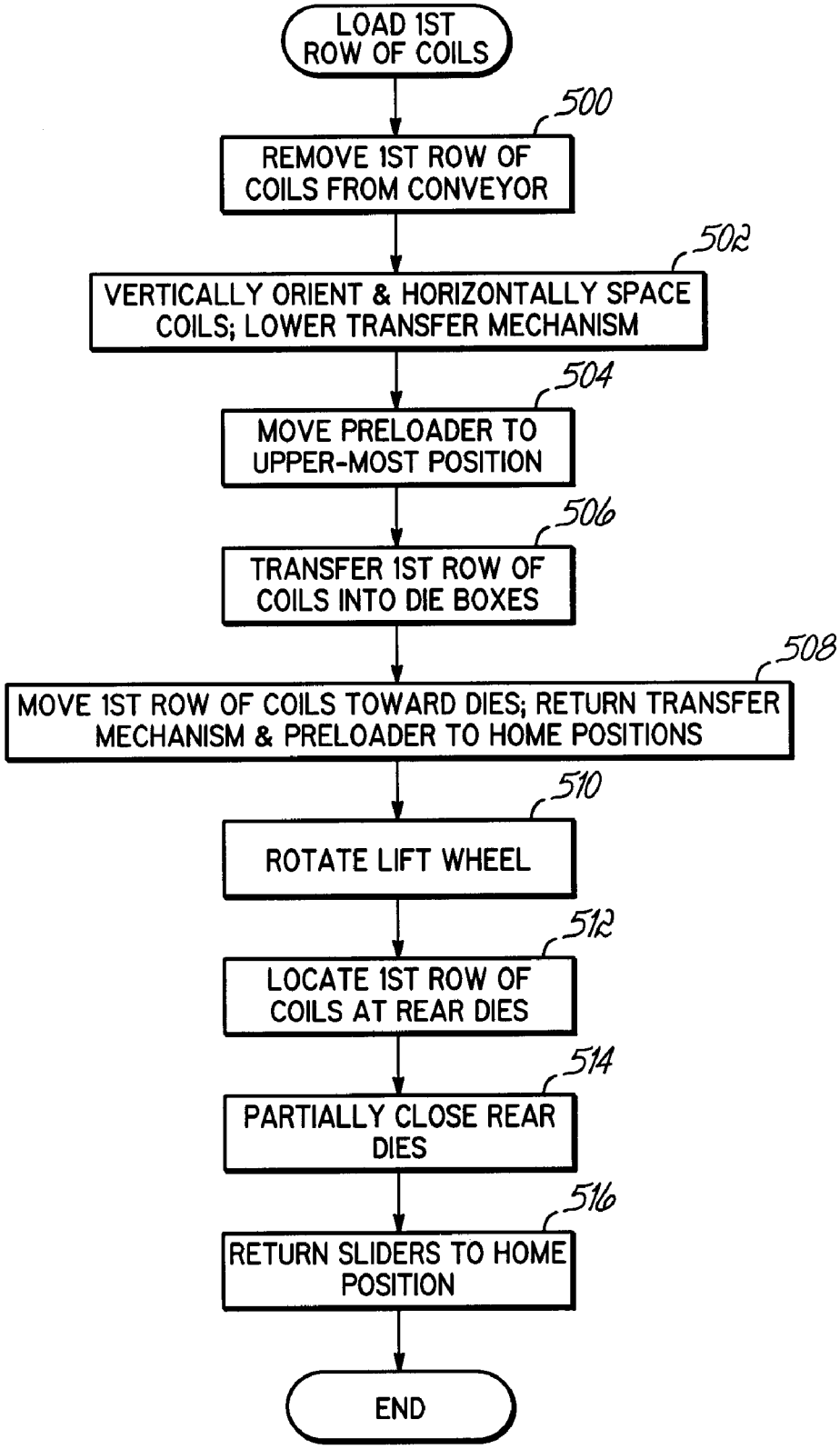
FIGS. 21–23 are graphical representations of various cycles of operation of the spring coil assembly machine of FIG. 1.

In use, referring to FIG. 1, a first row 21 (FIG. 2) of coils 227 is loaded onto the coil spring assembly machine 20 in accordance with a first cycle of operation as illustrated in FIG. 21. Prior to the operation of the assembly machine 20, a first row of coils 227 is fed by the conveyor 28 to a location in front of the preloader 30 that is determined by a sensor 264 (FIG. 19), for example, a proximity switch, connected to the control 110. Activation of the sensor 264 indicates that a full row of coils is properly located in front of the magazines 62. Referring to FIG. 21, at 500, the preloader servomotors 52 are operated by the control 110 to remove the row of coils from the feed conveyor 28. The servomotors 52 move the crank arms 54 toward, through and past their bottom-dead-center positions. That crankarm motion first moves the preloader 30 down to pick up a row of coils in the magazines 62 as previously described. The preloader 30 then reverses direction and is raised to its starting position. During that operation, the coils 227 in the magazines 62 are maintained in their initial horizontal and vertical orientations by the substantially vertical linear portions 87, 95 of the respective cam tracks 84, 92 (FIGS. 4, 5).

The preloader then, at 502, vertically orients and horizontally spaces the coils in the preloader. In this process, as the servomotors 52 and crankarms 54 continue to move the preloader 30 upward, the cam followers 83, 91 move through respective angular portions 85, 93 of the respective cam tracks 84, 92 (FIGS. 4, 5). Motion of the cam follower 83 along the angular portion 85 of cam track 84 causes the shaft 58 and magazines 62 to rotate about 90°, thereby orienting the row of coils in a substantially vertical direction. Simultaneously, the horizontal spacing of the cars 60, that is, the pitch of the coils in the first row, is changed, if desired, by the motion of the cam follower 91 along the angular portion 93 of the cam track 92 (FIG. 5).

While the preloader 30 is being raised by the preloader servomotors 52, the transfer drives 118 of the transfer mechanism 32 are operated by the control 110 to initiate a downward motion of the transfer mechanism 32. The operation of the downward motion of the transfer mechanism 32 that includes the horizontal transfer mechanism 138 and compression surface 162 must be timed so that it does not mechanically interfere with the rotation of the row of coils to their vertical orientation. After the transfer mechanism 32 reaches its lowermost position, the compression surface 162 is substantially parallel with the surface 166. Thereafter, at 504, the control 110 continues to operate the preloader servomotors 52; and the first row of coils continues to move upward until the top turns 164 (FIG. 8) of the first row of coils contact the compression surface 162 on the transfer mechanism 32. When the preloader crank arms 54 reach the top-dead-center position, the row of coils is completely compressed; and the preloader servomotors 52 are stopped. At this point, the first row of coils 227 is loaded in the coil assembly machine 20.

Next, the first row of coils must be transferred into the upper and lower die boxes 34, 36 (FIG. 8), it being understood that there is a pair of upper and lower die boxes 34, 36 for each of the coils 227 in the row. The control, at 506, operates the horizontal transfer motor 140, thereby causing the pusher bar 152 to move from left to right as viewed in FIG. 8. The pusher bar 152 simultaneously pushes all of the coils 227 in the first row over and between respective upper and lower sliders 210 of the upper and lower slider mechanisms 38, 40 to a position immediately downstream of the respective upper and lower sliders 210.

After the first row of coils 227 is properly positioned in front of the sliders 210, the control 110, at 508 of FIG. 21, operates the slider servomotors 202 (FIG. 1) to move sliders 210 from left to right as viewed in FIG. 8, thereby pushing the first row of coils 227 toward the front die 230. Upon initiating operation of the slider servomotors 202, the control, at 506, operates the horizontal transfer servomotor 140 to retract the pusher arm 152 to its home position. When the pusher arm 152 reaches its starting home position, the control 110 then, at 508, operates the vertical transfer servomotors 120 to move the transfer mechanism 32 upward to its home position. While the transfer mechanism 32 that includes the horizontal transfer drive 138 and compression surface 162 are returning to their respective home positions, the control 110 operates the preloader servomotors 52 causing the preloader 30 to return to its home position.

While the slider servomotors 202 are moving the first row of coils 227 toward the front die 230, the control, at 510, operates the lift wheel servomotors 284 in each of the upper and lower die boxes 34, 36, thereby causing all of the upper and lower lift wheels 292 to rotate through one revolution. The rotation of the lift wheels 292 performs no function when the first row of coils 227 is being loaded into the upper and lower die boxes 34, 36.

The control 110, at 512, continues to operate the slider servomotors 202, so that the upper and lower sliders 210 push the first row of coils 227 to a location adjacent the rear die 238. As the first row of coils 227 is moved downstream, lateral wings 220 (FIG. 9) maintain a proper lateral orientation of each coil. The sliders 210 push the first row of coils 227 completely past respective front dies 230 to a position adjacent respective rear dies 238 as shown in FIG. 8. After the sliders 210 have located the first row of coils 227, the control 110, at 514, operates the upper and lower die closing servomotors 330 (FIG. 1) in the upper and lower die boxes 34, 36 to partially close the rear dies 238 to a position shown in FIG. 17. In the partially closed position, the rear dies 238 are closed against the lower end turns of the first row of coils 227, thereby maintaining the coils in a desired orientation. Thereafter, at 516, the control 110 commands the slider servomotors 202 to return the upper and lower sliders 210 in the upper and lower die boxes 34, 36 to their starting home positions.

Figure 22:
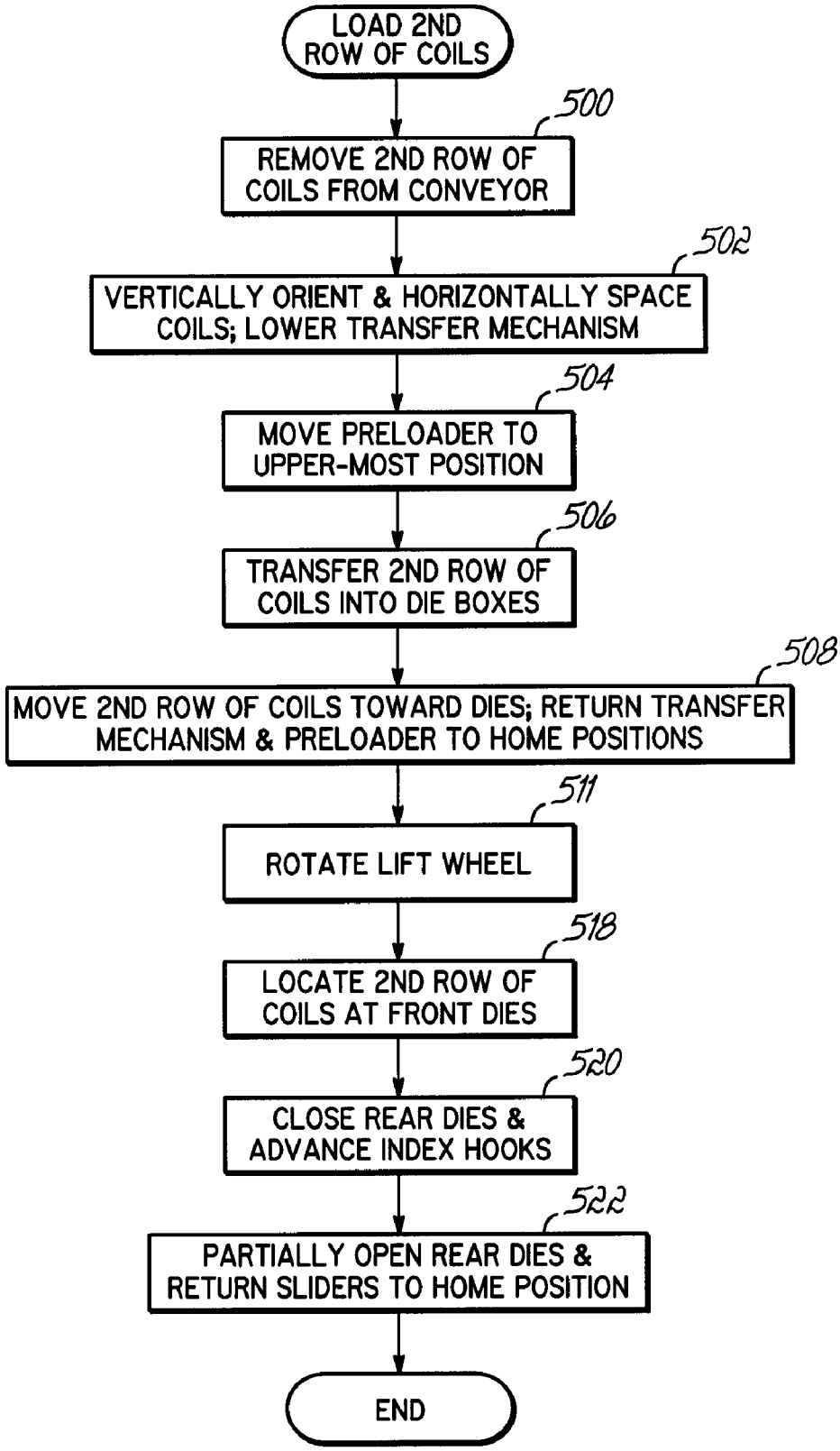

Next, a second row 23 (FIG. 2) of coils 260 is loaded onto the coil spring assembly machine 20 in accordance with a second cycle of operation as illustrated in FIG. 22. The operation of loading and pushing the second row of coils 260 into the upper and lower slider mechanisms 38, 40 as indicated at 500–508 of FIG. 22 is identical to that described with respect to the loading of the first row of coils 227 represented in FIG. 21. At 511, with the second row of coils, the control 110 operates the lift wheel servomotors 284 in the upper and lower die boxes 34, 36 to rotate each of the lift wheels 292 through a rotation of approximately 180° rotation, thereby raising a respective stop 310 (FIG. 13). The control 110, at 518, continues to operate the slider servomotors 202 to provide a slider stroke that positions each of the upper and lower downstream lacing legs 269 of the second row of coils 260 (FIG. 10) over a respective front die 230 and each of the upper and lower upstream lacing legs 270 against a respective lift wheel stop 310 (FIG. 13).

Thereafter, at 520, the control 110 operates the die closing servomotors 330 to fully close respective rear dies 238, thereby locating the upstream and downstream lacing legs 235, 269 (FIG. 10) of the respective first and second rows of coils 227, 260 between respective set of front and rear dies 230, 238. The control 110 also operates the indexing servomotors 382 to move the hook end 402*a* (FIG. 20) in each of the upper and lower die boxes 34, 36 in an upstream direction and under the downstream legs 229 of each coil in the first row of coils 227. Then, at 522, the control 110 operates the die closing servomotors 330 to move the upper and lower rear dies 238 back to the partially closed position of FIG. 17. Simultaneously, the control 110 operates the slider servomotors 202 to move the upper and lower sliders 210 in each of the respective upper and lower die boxes back to their home positions.

Figure 23:
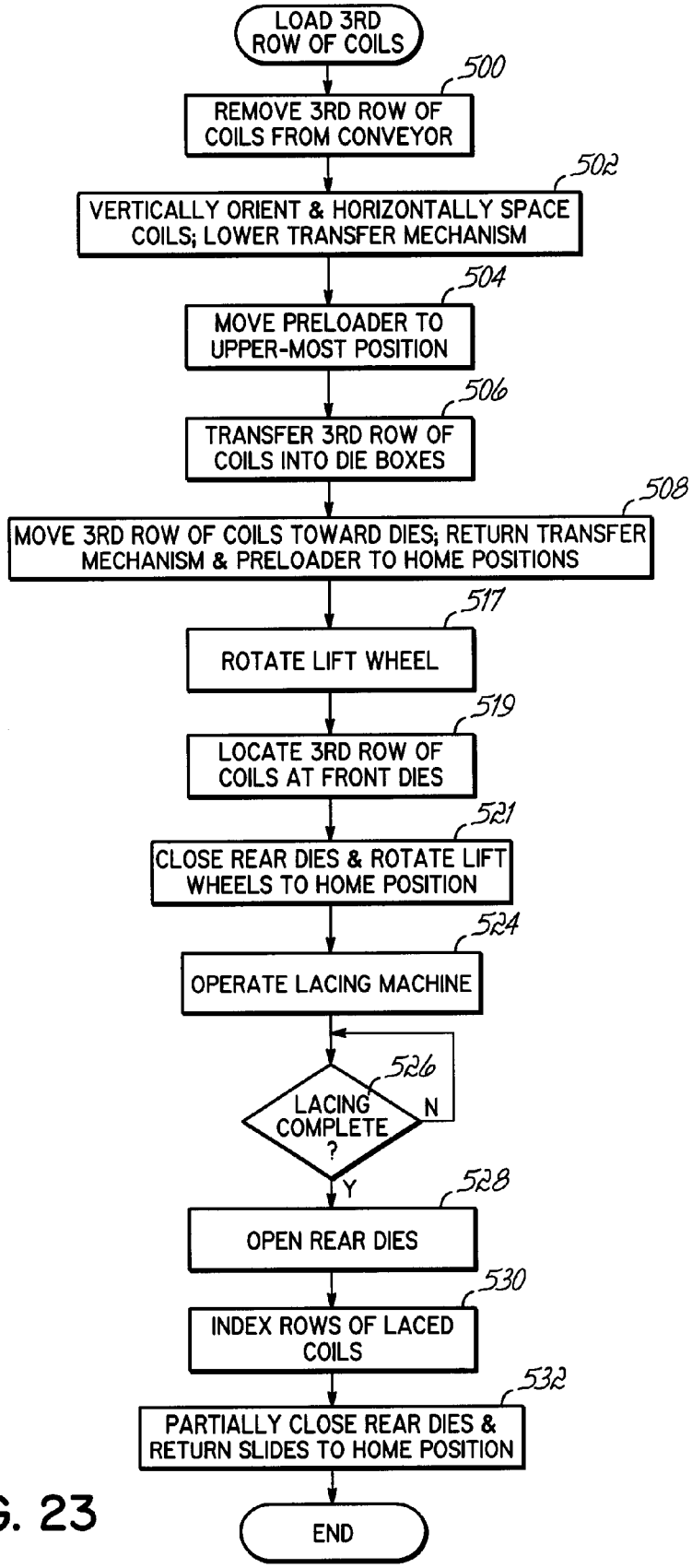

Next, a third row 24 (FIG. 2) of coils 278 that is to form a row of coaxial coils with the second row 23 of coils 260 is loaded onto the coil spring assembly machine 20 in accordance with a third cycle of operation as illustrated in FIG. 23. The operation of loading and pushing the third row 24 of coils 278 into the upper and lower slider mechanisms 38, 40 as indicated at 500–508 of FIG. 23 is identical to that described with respect to the loading of the respective first and second rows 22, 23 of coils 227, 260 described with respect to FIGS. 21 and 22. As the sliders 210 are moving the coils 278 of the third row toward respective front dies 230, the control 110, at 517, initiates operation of the lift wheel servomotors 284 in each of the upper and lower die boxes 34, 36. The lift wheels 292 first rotate through an arc of about 20° to move respective lifting cams 296 (FIG. 11) through respective slots 300 in respective upstream surfaces 228. The lifting cams 296 raise upstream short legs 276 in the top and bottom turns of the second row of coils 260. Thus, as the coils 278 in the third row are pushed toward respective front dies 230, respective downstream lacing legs 302 of the top and bottom turns of the coils 278 are pushed into cam slots 297 of the respective upper and lower lift wheels 292. The lift wheels 292 continue to rotate, the upstream short legs 276 are released from respective lifting cams 296 and drop on top of respective upstream lacing legs 302 of the third row of coils 278. Thus, the upstream lacing legs 302 of the third row of coils 278 have been located under the upstream short legs of the second row of coils 260.

The control 110, at 519, continues to operate the slider servomotors 202 to provide a slider stroke that positions each of the upper and lower downstream lacing legs 302 of the third row of coils 278 (FIG. 13) over a respective front die 230 and each of the upper and lower upstream lacing legs 270 against a respective lift wheel stop 310. Thereafter, at 521, the control 110 operates the die closing servomotors 330 to fully close respective rear dies 238, thereby locating the upstream and downstream lacing legs 235, 269, 302 of the first, second and third rows of coils 227, 260, 278, respectively, between each set of front and rear dies 230, 238 in each of the upper and lower die boxes 34, 36. In addition, at 521, the control 110 commands the lift wheel servomotors 284 to rotate the lift wheels to the home position.

Thereafter, at 524, the control 110 provides a cycle start signal to the lacing machines 370*a*, 370*b* (FIG. 2) that, in turn, wind, respective lacing wires 256, 258 around all of the adjacent lacing legs in the upper and lower die sets 42, 44 in a known manner. At the end of the lacing wire winding process, the lacing machines 370*a*, 370*b* proceed to cut and bend the lacing wires 256, 258 in a known manner. Thereafter, at 526, when the control 110 detects cycle complete signals from the respective lacing machines 370, the control 110, at 528, operates the die closing servomotors 330 in the upper and lower die boxes 34, 36 to open the respective rear dies 238.

Next, at 530, the control 110 proceeds to index the three rows of laced coils toward the rear of the coil assembly machine 20. As shown in FIG. 2, the rows of laced coils are comprised of a single row 21 of coils 227 and two rows 23, 24 of coaxial coils 260, 278. The control 110 operates the slider servomotors 202 and the indexer servomotors 382 to index the laced rows of coils downstream toward the rear of the coil spring assembly machine 20. In this process, the control 110 again operates the slider servomotors 202 to again initiate motion of the sliders 210 toward the rear of the coil assembly machine 20. Simultaneously, the control 110 initiates operation of the indexing servomotors 382, and the indexing hooks 392 (FIG. 20) are moved downstream toward the rear of the assembly machine. The hook end 402*a* is effective to pull the downstream leg 229 of the first row of coils 227 toward the rear of the machine 20. As previously noted, when the next row of laced coils is indexed, both of the hook ends 402*a*, 402*b* engage respective downstream legs 229, 233 to pull the next row of coils toward the rear of the machine.

The operation of the indexing hooks 392 and sliders 210 continues until the second and third rows of coils 260, 278 are moved to a location previously occupied by the first row of coils 227. At that location, the second and third rows of coils 260, 278 are located completely behind the front die 230 with their upstream legs 276, 312 forward of the rear dies 238. As the laced rows of coils 227, 260, 278 are moved downstream toward the rear dies 238, the coils are maintained in lateral alignment by the wings 220 (FIG. 9). Thereafter, at 532, the control 110 operates the die closing servomotors 330 to move the rear dies forward to the partially closed position, thereby locating the rear dies 238 against the upstream lacing legs 270, 312 of the coaxial coils 260, 278 to maintain the alignment of the laced rows of coaxial coils. In addition, the control 110 operates the slider servomotors 202 to return the sliders 210 to their home positions.

Subsequent rows of single coils and coaxial coils are stacked and laced as described with respect to FIGS. 21–23. The appropriate cycle being selected depending on the configuration of coils in a row. The last row of coils is processed substantially in accordance with the cycle shown in FIG. 23. The only exception is at the last process step 532. With the last row of coils, the last process step is modified in two ways. First, the control 110 does not close the rear dies 238; but the rear dies 238 remain in their open position in order to accept a first row of coils of the next array of coils to be laced together. Further, the control 100 operates the indexing servomotors 330 to move the indexing hooks 292 upstream toward the front of the assembly machine, so that the next first row of coils are loaded over the indexing hooks 292.

The coil spring assembly machine 20 is thus capable of stacking one or more rows of coaxial coils along with rows of single coils in order to provide a spring structure of a matrix of coil springs that has areas of different firmness or stiffness. The coil spring assembly machine 20 has a preloader 30 that is smaller and more reliable than known preloaders. The smaller size of the preloader 30 provides an operator greater access to the die boxes 34, 36, thereby making maintenance of the die boxes substantially easier than with known machines. Further, the die closing mechanism 328 uses a toggle mechanism 150 that consistently and reliably properly closes the dies 230, 238. The toggle mechanism maintains the dies in their desired parallel relationship and does not provide or require any adjustment by the user. Improper adjustment of the die closing mechanism is a significant source of problems on known machines. Further, the generally linear approach of the rear die toward the front die upon closing provides a more reliable and proper alignment of coil springs within the dies and minimizes the likelihood of oblique forces that can stress and break a die over time.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, referring to FIG. 24, in an alternative embodiment of the pusher bar 152, pusher fingers 374 are mounted to the top and bottom of the pusher bar 152. To move the coil 278 from left to right, outer surface 279 of the pusher bar 152 contacts on outer surface of a middle turn 373 of the coil 278; and the pusher fingers 374 contact inside surfaces of upper and lower turns 376. This three-point contact reliably pushes the row of coils 278 into the upper and lower slider mechanisms 38, 40. Further, as will be appreciated, the spline shaft 58 can be replaced by a shaft having a different noncircular cross-sectional profile, for example, an elliptical or square cross-sectional profile. Such profiles permit the cars 60 to slide longitudinally on the shaft, but the cars are rotated along with any rotation of the shaft Therefore, the invention in its broadest aspects is not limited to the specific details shown and described. Consequently, departures may be made from the details described herein without departing from the spirit and scope of the claims which follow.

What is claimed is:

1. An apparatus for assembling coil springs together into a matrix of coil springs, each of the coil springs having a centerline and a pair of end turns substantially perpendicular to the centerline, the end turns being interconnected by at least one intermediate turn, the coil springs being supplied by a conveyor, the apparatus comprising:

workholders having respective grippers adapted to receive and hold end turns of respective coil springs;

a loader supporting the workholders and being operable to move the workholders through a motion adapted to transfer the respective coil springs from the conveyor to the apparatus.

2. The apparatus of claim 1 further comprising a plurality of die sets, and the loader further comprises a pusher bar operable to push the coil springs in the workholders to a location adjacent respective die sets.

3. The apparatus of claim 1 wherein the loader comprises:

a first mechanism being operable to rotate the workholders about 90° with respect to an axis of rotation; and a second mechanism being operable to separate the workholders.

4. The apparatus of claim 3 wherein the second mechanism being operable to separate the workholders in a direction substantially parallel to the axis of rotation and substantially simultaneously with the first mechanism rotating the workholders.

5. The apparatus of claim 4 wherein the loader further comprises a shaft for supporting the workholders, the workholders being mounted on the shaft to permit relative motion longitudinally on the shaft, but the shaft engaging the workholders for simultaneous rotational motion.

6. The apparatus of claim 5 wherein the shaft is a spline shaft.

7. The apparatus of claim 5 wherein the workholders are mechanically coupled together on the shaft to permit each of the workholders to separate from adjacent workholders by substantially equal increments.

8. The apparatus of claim 1 wherein the workholder further comprises a plurality of magazines mounted on the loader, each of the plurality of magazines adapted to receive and hold a turn of a coil spring.

9. The apparatus of claim 8 wherein the plurality of magazines are movable in a first motion pushing the plurality of magazines over turns of first coil springs on the conveyor, thereby securing a first coil spring in a respective magazine.

10. The apparatus of claim 9 wherein the loader and the coil springs held in the plurality of magazines are movable through a second motion substantially opposite the first motion and adapted to remove the first coil springs in the magazines from the conveyor.

11. The apparatus of claim 10 wherein the first coil springs held in the plurality of magazines are movable through a pivoting motion adapted to rotate centerlines of the first coil springs to a substantially vertical direction.

12. The apparatus of claim 8 wherein each of the magazines captures and holds a portion of a turn of the coil spring.

13. The apparatus of claim 12 wherein each of the magazines comprises fixed and resilient members that capture the portion of the turn of the coil spring therebetween.

14. A workholder of a coil spring assembly machine that assembles successive groups of coil springs into a matrix of coil springs, each of the coil springs having a centerline and end bottom turns substantially perpendicular to the centerline, the end turns being interconnected by at least one intermediate turn, the workholder comprising:

a base plate;

a gripper mounted on the base plate; and a compression plate interposed between the base plate and the gripper, the compression plate being resiliently mounted relative to the base plate and adapted to receive a turn of a coil spring between the gripper and the compression plate.

15. The workholder of claim 14 further comprising a pair of grippers.

16. The workholder of claim 14 further comprising a leaf spring between the base plate and the compression plate.

17. The workholder of claim 14 wherein the gripper has a relief adapted to receive and guide a turn of the coil spring between the gripper and the compression plate.

18. An apparatus for assembling coil springs together into a matrix of coil springs, each of the coil springs having a centerline and a pair of end turns substantially perpendicular to the centerline, the end turns being interconnected by at least one intermediate turn, the apparatus comprising:

a stationary die adapted to receive an end turn of a first coil spring, the stationary die having a planar die face substantially perpendicular to the centerline of the first coil spring;

a movable die adapted to receive an end turn of a second coil spring, the movable die having a planar die face substantially parallel to the planar die face of the stationary die;

a drive; and a four bar linkage connected between the movable die and the drive and operable to move the movable die through a motion that maintains the planar die face of the movable die substantially parallel to the planar die face of the stationary die.

19. The apparatus of claim 18 wherein the movable die is one link of the four bar linkage.

20. The apparatus of claim 19 wherein the linkage further comprises a toggle pivotally connected to the four bar linkage.

21. The apparatus of claim 20 wherein the drive further comprises a linear drive connected to the toggle.

22. An apparatus for assembling coil springs together into a matrix of coil springs, each of the coil springs having a centerline and a pair of end turns substantially perpendicular to the centerline, the end turns being interconnected by at least one intermediate turn, the apparatus comprising:

a stationary die adapted to receive a turn of a first coil spring;

a movable die adapted to receive a turn of a second coil spring;

a pair of parallel guide links having first ends adapted to be pivotally connected to the machine and second ends pivotally connected to the movable die;

a toggle having a first toggle link having one end pivotally connected to a second end of one of the guide links, and a second toggle link having one end pivotally connected to an opposite end of the first toggle link, the second toggle link having an opposite end adapted to be pivotally connected to the machine;

a drive link having one end pivotally connected to the toggle; and a drive operable to move an opposite end of the drive link through a first motion that moves the movable die to an open position at which the moving die is separated from the stationary die, and a second motion that moves the movable die to a closed position at which the movable die is in juxtaposition with the stationary die.

23. An apparatus for assembling coil springs together into a matrix of coil springs, each of the coil springs having a centerline and a pair of end turns substantially perpendicular to the centerline, the end turns being interconnected by at least one intermediate turn, and each of the end turns having a short leg and an opposed lacing leg, coil springs being connectable with each other by a lacing wire wound around lacing legs of respective coil springs, the apparatus comprising:

a die set having first and second dies movable with respect to each other; and a lifter mounted adjacent the die set and being movable to lift an upstream leg of an end turn on a first coil spring located in the die set to permit a downstream leg of an end turn of a second coil spring to be moved below the upstream leg of the first coil spring, thereby forming a pair of coaxial coils.

24. An apparatus for assembling rows of coil springs together into a matrix of coil springs, each of the coil springs having a centerline and a pair of end turns substantially perpendicular to the centerline, the end turns being interconnected by at least one intermediate turn, each of the end turns having a short leg and an opposed lacing leg, and the coil springs being connectable with each other by a lacing wire wound around lacing legs of respective coil springs, the apparatus comprising:

a plurality of die sets, each of the die sets having first and second dies movable with respect to each other; and a plurality of lifters, each lifter being mounted adjacent a different one of the die sets and being movable to lift a short leg of an end turn of a first coil spring in the first row of coil springs that is located in a respective die set to permit a lacing leg of an end turn of a first coil spring in a second row of coil springs to be moved below the short leg of the first coil spring of the first row of coils, thereby forming a row of coaxial coil springs from the coil springs in the first and second rows.

25. The magazine of claim 24 wherein the plurality of lifters further comprises a plurality of lifter wheels, each lifter wheel being located adjacent a different one of the plurality of die sets and comprising a lift cam.

26. The magazine of claim 25 further comprising a drive shaft, the plurality of lifter wheels being mounted on, and rotatable by, the drive shaft, each of the lift cams of respective lifter wheels adapted to contact and lift the short leg of the coil spring in the first row of coils in response to rotation of the lifter wheel.

27. The magazine of claim 26 wherein each of the plurality of lifter wheels further comprising a stop cam having a stop surface for locating a lacing leg of an end turn of a coil spring in the first row of coil springs that is adjacent the first coil spring in the first row of coil springs.

28. The magazine of claim 27 wherein each stop surface locates a lacing leg of an end turn of a coil spring that is adjacent the first coil spring in the second row of coil springs.

29. An apparatus for assembling coil springs together into a matrix of coil springs, each of the coil springs having a centerline and a pair of end turns substantially perpendicular to the centerline, the end turns being interconnected by at least one intermediate turn, the apparatus comprising:

a plurality of pairs of upper and lower die sets, each die set having a stationary forward die and a movable rear die;

a plurality of pairs of upper and lower sliders, each pair of upper and lower sliders being located upstream of the respective pair of upper and lower die sets and being movable along respective linear paths toward and away from the respective pair of upper and lower die sets, the plurality of pairs of sliders being operable to successively position a first row of coils springs and a second row of coil springs immediately adjacent each other to form a row of coaxial coil springs; and a loader adapted to successively locate the first and second rows of coil springs downstream of the plurality of pairs of upper and lower sliders and upstream of the plurality of pairs of upper and lower die sets.

30. The spring coil assembly machine of claim 29 wherein each end turn of each coil spring has a short leg and an opposed lacing leg, and the apparatus further comprises a plurality of pairs of upper and lower lifters located upstream of respective pairs of upper and lower die sets, each of the lifters operating substantially simultaneously to lift a short leg of an end turn of a coil spring in the first row of coil springs located in a respective die set to permit a lacing leg of an end turn of a coil in the second row of coil springs to be moved under the short leg of the coil in the first row of coil springs, thereby forming a row of coaxial coil springs.

31. An apparatus for assembling rows of coils together into a matrix of coil springs, each of the coil springs having a centerline and a pair of end turns substantially perpendicular to the centerline, the end turns being interconnected by at least one intermediate turn, the coil springs being supplied by a conveyor and the apparatus comprising:

a preloader adapted to transfer a first row of coil springs from the conveyor to the apparatus;

a plurality of pairs of upper and lower die sets;

a plurality of pairs of upper and lower sliders, each pair of upper and lower sliders being located upstream of a different one of the upper and lower die sets;

a transfer device moving along a linear path and adapted to push the first row of coils from the preloader to a location downstream of the plurality of sliders and upstream of the plurality of die sets, the plurality of sliders being operable to move the first row of coils into the plurality of die sets.

32. The apparatus of each claim 31 wherein end turn of each coil spring has a short leg and an opposed lacing leg, and the apparatus further comprises pairs of upper and lower lifters, each pair of upper and lower lifters being positioned between a pair of upper and lower forward dies and a respective pair of upper and lower sliders, each pair of upper and lower lifters adapted to raise short legs of respective end turns of a second row of coils as the pairs of upper and lower sliders push short legs of respective end turns of a second rows of coils under the short legs of respective end turns of the first row of coils.

33. The spring coil assembly machine of claim 32 wherein the sliders are adapted to push lacing legs of respective end turns of the second row of coils over lacing legs of respective end turns of the first row of coils.

34. A method of positioning coil springs with respect to a die set on a coil spring assembly machine, each of the coil springs having a centerline and end turns that are substantially perpendicular to the centerline, the end turns being interconnected by at least one intermediate turn, and each of the end turns having one short leg and an opposed lacing leg, the coil springs being supplied by a conveyor, the method comprising:

securing an end turn of a coil spring on the conveyor with a gripper;

transferring the coil spring with the end turn from the conveyor to the coil spring assembly machine; and transferring the coil spring from the gripper to a location adjacent the die set.

35. The method of claim 34 further comprising securing the end turn of a coil spring on the conveyor with a resiliently biased gripper.

36. The method of claim 35 further comprising pushing the coil spring from the gripper to a location adjacent the die set with a pusher bar moving along a linear path.

37. A method of positioning coil springs with respect to a die set having fixed and movable dies on a coil spring assembly machine, each of the coil springs having a centerline and end turns that are substantially perpendicular to the centerline, the end turns being interconnected by at least one intermediate turn, and each of the end turns having one short leg and an opposed lacing leg, the method comprising:

automatically moving a first coil spring to a location where an upstream leg of an end turn of the first coil spring is located between the fixed and movable dies;

automatically moving a second coil spring to a location where a downstream leg of an end turn of a second coil spring is located between the fixed and movable dies;

automatically moving the movable die with a four bar linkage mechanism and a toggle toward the fixed die while maintaining a planar die face of the movable die substantially parallel to a planar die face of the fixed die to secure the upstream leg of the first coil spring against the downstream leg of the second coil spring.

38. A method of positioning coil springs with respect to a die set on a coil spring assembly machine, each of the coil springs having a centerline and end turns that are substantially perpendicular to the centerline, the end turns being interconnected by at least one intermediate turn, and each of the end turns having one short leg and an opposed lacing leg, the method comprising:

automatically moving a first coil spring to a location where a lacing leg of an end turn of the first coil spring is located in the die set;

automatically moving a second coil spring toward the first coil spring; and automatically locating one leg of an end turn of the second coil spring beneath a leg of an end turn of the first coil spring to provide coaxial coil springs from the first and second coil springs.

39. The method of claim 38 comprising automatically locating a short leg of an end turn of the second coil spring beneath a short leg of the end turn of the first coil spring.

40. A The method of claim 39 further comprising:

automatically raising the short leg of the end turn of the first coil spring; and automatically moving a lacing leg of the end turn of the second coil beneath a raised short leg of the first coil.

41. The method of claim 40 further comprising automatically locating a lacing leg of the end turn of the second coil spring in the die set over the lacing leg of the end turn of the first coil spring.

42. A method of positioning rows of coil springs with respect to die sets on a coil spring assembly machine, each of the coil springs having a centerline and end turns that are substantially perpendicular to the centerline, the end turns being interconnected by at least one intermediate turn, and each of the end turns having one short leg and an opposed lacing leg, the method comprising:

automatically moving a first row of coil springs to a location where lacing legs of first coil springs of the first row of coils are located in respective die sets;

automatically moving a second row coil springs toward the die sets;

automatically locating short legs of first coil springs of the second row of coil springs beneath short legs of the first coil springs of the first row of coil springs to provide a row of coaxial coil springs from the first and second rows of coil springs.

43. The method of claim 42 further comprising automatically locating lacing legs of the first coil springs of the second row of coil springs beneath short legs of the first coil springs of the first row of coil springs as the second row of coil springs is moved toward the die sets.

44. The method of claim 43 futher comprising automatically raising the short legs of the first coils of the first row of coil springs as the second row of coils is moved toward the die sets.

45. The method of claim 42 further comprising automatically locating lacing legs of the first coil springs of the second row of coil springs in the respective die sets with the lacing legs of the first coils of the first row of coil springs.

46. The method of claim 42 further comprising automatically locating lacing legs of second coil springs of the first row of coil springs lower than lacing legs of second coil springs of the second row of coil springs to facilitate locating the lacing legs of the second coil springs of the second row of coil springs over the lacing legs of the second coil springs of the first row of coil springs.

47. The method of claim 46 further comprising automatically locating short legs of the second coil springs of the second row of coil springs over short legs of the second coil springs of the first row of coil springs.

48. A method of positioning rows of coil springs on a coil assembly machine, each of the coil springs having a centerline and end turns that are substantially perpendicular to the centerline, the end turns being interconnected by at least one intermediate turn, and each of the end turns having one short leg and an opposed lacing leg, the method comprising:

automatically moving a first row of coil springs to a location where upstream lacing legs of first coils of the first row of coil springs are located between a fixed die and a movable die;

automatically moving a second row of coil springs to a location where downstream lacing legs of first coil springs in the second row of coil springs are located between the fixed die and the movable die; and automatically moving a third row of coil springs to a location where downstream lacing legs of first coils in the third row of coils are located between the fixed die and the movable die and upstream short legs of the first coils of the third row of coils are located below upstream short legs of the first coils of the second row of coils, the second and third rows of coils forming a coaxial row of coils.

49. The method of claim 48 further comprising:

automatically closing the movable die against the fixed die to secure the lacing legs of the first coils of the first, second and third rows of coils therein; and automatically lacing the lacing legs of the first coils of the first, second and third rows of coils together.

* * * * *

UNITED STATES PATENT AND TRADEMARK OFFICE

CERTIFICATE OF CORRECTION

PATENT NO. : 6,698,459 B2
DATED : March 2, 2004
INVENTOR(S) : Terry Aronson

It is certified that error appears in the above-identified patent and that said Letters Patent is hereby corrected as shown below:

Drawings,
Fig. 23, in box #532, "SLIDES" should read -- SLIDERS --.

Figure 24:
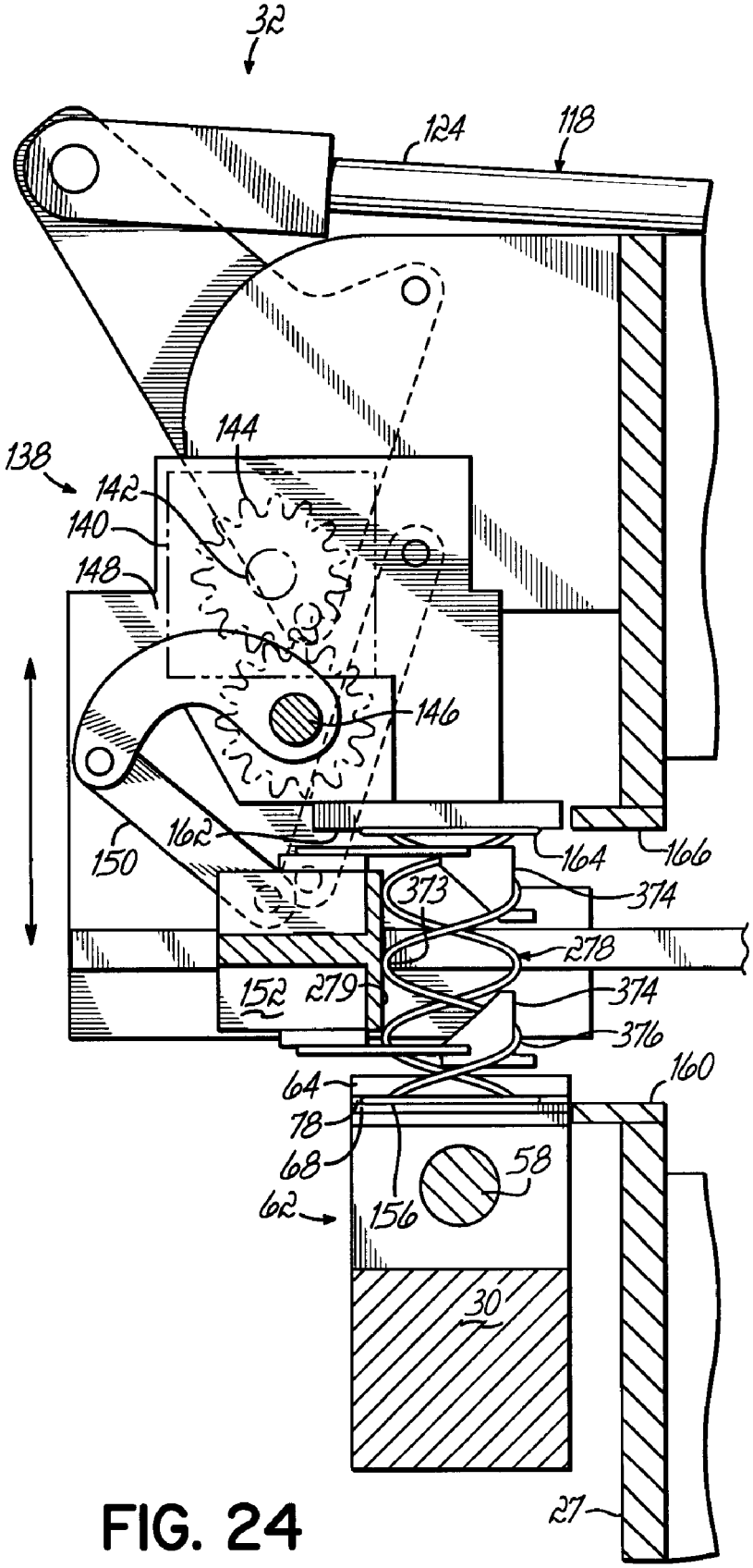
FIG. 24 is side view in elevation of an alternative embodiment of a pusher bar used on the coil spring assembly machine of FIG. 1.

Column 5,
Line 7, "FIG.24 is side view" should read -- FIG. 24 is a side view --.

Column 9,
Line 12, "rotation of the servomotors 202 cause" should read -- rotation of the servomotors 202 causes --.
Line 37, "have respective lacing legs" should read -- has respective lacing legs --.
Line 59, "cause respective sliders" should read -- causes respective sliders --.

Column 12,
Line 26, "stop surface 310 function" should read --stop surface 310 functions --.
Line 52, "is identical" should read -- are identical --.

Column 14,
Line 41, "the hook end" should read -- the hook ends --.
Line 47, "402b, 402b function to pull laced rows of coils towards" should read -- 402a, 402b, function to pull laced rows of coils toward --.

Column 16,
Line 45, "between respective set" should read -- between respective sets --.

Column 17,
Line 34, "wind, respective" should read -- wind respective --.

Column 18,
Line 27, "first row of coils are" should read -- first row of coils is --.
Line 53, "restrict nor" should read -- restrict or --.

Column 19,
Line 2, "rotation of the shaft" should read -- rotation of the shaft. --.

Column 22,
Line 15, "row of coils springs" should read -- row of coil springs --.
Line 51, "The apparatus of each claim 31 wherein end turn" should read -- The apparatus of claim 31 wherein each end turn --.
Line 60, "rows of coils " should read -- row of coils --.

UNITED STATES PATENT AND TRADEMARK OFFICE

CERTIFICATE OF CORRECTION

PATENT NO. : 6,698,459 B2
DATED : March 2, 2004
INVENTOR(S) : Terry Aronson

It is certified that error appears in the above-identified patent and that said Letters Patent is hereby corrected as shown below:

Column 23,
Line 54, "The method of claim 38 comprising" should read -- The method of claim 38 further comprising --.

Column 24,
Line 9, "a second row coil springs" should read -- a second row of coil springs --.

Signed and Sealed this

Twenty-eighth Day of September, 2004

JON W. DUDAS
*Director of the United States Patent and Trademark Office*